US007653322B2

(12) United States Patent
Maeda et al.

(10) Patent No.: US 7,653,322 B2
(45) Date of Patent: Jan. 26, 2010

(54) FIXING APPARATUS, IMAGE FORMING APPARATUS, TEMPERATURE CONTROL METHOD FOR FIXING APPARATUS, TEMPERATURE CONTROL PROGRAM, AND STORAGE MEDIUM STORING THE PROGRAM

(75) Inventors: Tomohiro Maeda, Yao (JP); Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 434 days.

(21) Appl. No.: 11/684,194

(22) Filed: Mar. 9, 2007

(65) Prior Publication Data

US 2007/0217807 A1 Sep. 20, 2007

(30) Foreign Application Priority Data

Mar. 15, 2006 (JP) ..... 2006-070914

(51) Int. Cl.
*G03G 15/20* (2006.01)

(52) U.S. Cl. ..... 399/69; 399/67; 399/330

(58) Field of Classification Search ..... 399/67, 399/69, 82, 320, 328, 329, 330; 219/216, 219/494; 430/124, 124.3
See application file for complete search history.

(56) References Cited

U.S. PATENT DOCUMENTS

| | | | | |
|---|---|---|---|---|
| 6,411,785 | B1 * | 6/2002 | Ogawahara et al. | 399/69 |
| 2005/0117930 | A1 * | 6/2005 | Akizuki et al. | 399/69 |
| 2005/0226660 | A1 * | 10/2005 | Fuma | 399/328 |

FOREIGN PATENT DOCUMENTS

| | | |
|---|---|---|
| JP | 64-052184 | 2/1989 |
| JP | 10-149044 | 6/1998 |
| JP | 2001-175119 | 6/2001 |
| JP | 2002-049272 | 2/2002 |
| JP | 2002-049273 | 2/2002 |
| JP | 2002-182503 | 6/2002 |

* cited by examiner

*Primary Examiner*—David P Porta
*Assistant Examiner*—Benjamin Schmitt
(74) *Attorney, Agent, or Firm*—Renner, Otto, Boisselle & Sklar, LLP

(57) ABSTRACT

Comparisons are made independently for a controlled target temperature and a detected temperature of an endless belt, and a controlled target temperature and a detected temperature of a fixing roller. The operation of a halogen lamp installed in an external heating section is controlled based on results of these comparisons. This allows a temperature of the fixing member to be controlled more appropriately in a fixing apparatus that includes an external heating section for heating the fixing member.

18 Claims, 11 Drawing Sheets

FIXING APPARATUS, IMAGE FORMING APPARATUS, TEMPERATURE CONTROL METHOD FOR FIXING APPARATUS, TEMPERATURE CONTROL PROGRAM, AND STORAGE MEDIUM STORING THE PROGRAM

This Nonprovisional application claims priority under 35 U.S.C. § 119(a) on Patent Application No. 070914/2006 filed in Japan on Mar. 15, 2006, the entire contents of which are hereby incorporated by reference.

FIELD OF THE INVENTION

The present invention relates to a fixing apparatus in which an unfixed toner image on printing paper is fixed thereon with heat and pressure in image forming apparatuses such as a copying machine, a printer, and a facsimile machine.

BACKGROUND OF THE INVENTION

As a conventional fixing apparatus installed in image forming apparatuses of the electrophotographic system, a fixing apparatus of a roller pair system has been available that includes a fixing roller and a pressing roller.

The fixing roller includes, for example, a hollow metal core of aluminum or the like coated with an elastic layer, and a halogen lamp is installed as a heat source inside the metal core. In this type of fixing roller, the halogen lamp is turned ON/OFF with a temperature control circuit in response to a signal from a temperature sensor provided on the surface of the fixing roller. In this way, the surface temperature of the fixing roller is maintained constant.

The pressing roller includes a metal core with a heat-resistant elastic layer, such as a silicon rubber, which is coated around the metal core. When the pressing roller and the fixing roller are pressed against each other, a predetermined nip region is formed as the elastic layer undergoes elastic deformation. In the fixing apparatus of the roller pair system, a sheet of paper with a transferred unfixed toner image is passed through the nip region and the toner image is thermally fixed on the sheet by fusing the toner with heat.

There is a drawback in common fixing apparatuses of the roller pair system. When continuously feeding more than one sheet at high speed, the surface temperature of the fixing roller drops greatly, and this makes it difficult to maintain the surface temperature of the fixing roller constant. This problem is attributed to the fact that the generated heat inside the metal core is transferred to the toner image via the elastic layer (for example, silicon rubber) with poor heat conductivity, and because of this it takes a considerable amount of time for the heat of the heat source to be transferred to the surface of the fixing roller.

As a countermeasure, there has been proposed a fixing apparatus of an external heating system, which includes an external heating section that heats the fixing roller from outside by being brought into contact with the periphery of the fixing roller.

For example, Patent Publication 1 (Japanese Laid-Open Patent Publication No. 64-52184 (published on Feb. 28, 1989) discloses a fixing apparatus that includes: first detecting means for detecting a surface temperature of a heat roller in which a heater is installed; second detecting means for detecting a temperature of an external heating section that heats the heat roller; and a control section for controlling the external heating section based on results of detection by these detecting means. The control section includes a bridge circuit connected in parallel to the first detecting means and the second detecting means; a comparator for comparing the output of the bridge circuit with a reference voltage; and ON/OFF means for turning ON/OFF the external heating section based on the output of the comparator.

Further, Patent Publication 1 describes detecting a temperature drop on the surface of the heat roller as caused by feeding, and compensating for it with the external heating section. As described in this publication, controlling the external heating section according to the result of temperature detection alleviates fluctuations of fixing temperature due to changes in amount of feeding.

However, in the technique disclosed in Patent Publication 1, the first detecting means and second detecting means are connected to each other in parallel, and a mean resistance of these two detecting means is used for feedback in the temperature control of the external heating section. As such, the temperature control does not reflect individual results of temperature detection for the fixing member and the external heating section, with the result that the temperatures of these members cannot accurately be controlled at target temperatures.

The temperature control of the external heating section may be made based solely on the result of detection of surface temperature of the external heating section. However, in this case, the surface temperature of the fixing member may gradually increase and exceed the pre-set paper feed temperature when, for example, intermittently feeding a single sheet of paper (making single copies), owning to the fact that the temperature of the fixing member is not monitored. Alternatively, the temperature control of the external heating section may be made based solely on surface temperature of the fixing member. While this may be able to maintain the surface temperature of the fixing member within a predetermined temperature range when the number of feeds is small, it causes delayed detection and generates undershoot in the early stage of feeding during a continuous paper feed.

In a color image forming apparatus, the external heating section requires accurate temperature control when the monochromatic mode and the color mode have different processing speeds (feeding speeds). The following describes this in detail.

When the monochromatic mode and the color mode have different processing speeds (feeding speeds), the fixing temperature (temperature of the fixing member) also differs between these modes. As such, in these modes, there is only a narrow temperature range (common non-offset range) in which fixing defects or offset (low-temperature offset or high-temperature offset) due to excessively low fixing temperatures do not occur (in some cases, such common non-offset range may not exist at all). For example, the color mode requires a fixable temperature range of 160° C. to 190° C., inclusive (fixing defects occur below 160° C., and high-temperature offset occurs above 190° C. If the monochromatic mode requires a fixable temperature range of 180° C. to 210° C., inclusive (fixing defects occur below 180° C., and high-temperature offset occurs above 210° C.), the common non-offset range is confined between 180° C. and 190° C., inclusive.

In this case, the fixing member needs to be maintained throughout the standby period at a temperature that allows for feeding in the both modes, in order to allow a quick start for the feeding operation. More specifically, the temperature needs to be maintained between the lower limit of the fixable temperature for the monochromatic mode (180° C. in the foregoing example) and the upper limit of the fixable temperature for the color mode (190° C.). Further, in order to allow the image formation modes to be switched quickly, the temperature of the fixing member also needs to be confined in this temperature range.

The surface temperature of the fixing member can be controlled more accurately by varying the surface temperature of the fixing member through the temperature control of the external heating section brought into contact with the surface of the fixing member, rather than varying the surface temperature through the temperature control of the heat source provided inside the fixing member. Thus, temperature control of the external heating section is particularly important when the temperature of the fixing member needs to be accurately controlled within a narrow temperature range as in the foregoing case where the monochromatic mode and the color mode use different processing speeds (feeding speeds).

SUMMARY OF THE INVENTION

The present invention was made in view of the foregoing problems, and an object of the invention is to appropriately control temperature of an external heating member so that temperature of a fixing member varies within a temperature range that allows for fixing without causing fixing defects, in a fixing apparatus provided with an external heating member that heats a fixing member.

In order to achieve the foregoing object, a fixing apparatus according to the present invention includes: a fixing member; a pressing member; and an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, the fixing apparatus including: a first temperature-detecting device for detecting a surface temperature of the external heating member; a second temperature-detecting device for detecting a surface temperature of the fixing member; and a control section for performing first control by which a heating operation of the first heating device is controlled based on a first comparison result, which is a result of comparison between a temperature detected by the first temperature-detecting device and a controlled target temperature of the external heating member, and a second comparison result, which is a result of comparison between a temperature detected by the second temperature-detecting device and a controlled target temperature of the fixing member.

In the case where the surface temperature of the external heating member as detected by the first temperature-detecting device has not reached the controlled target temperature of the external heating member, heating the external heating member may cause the temperature of the fixing member to increase above the controlled target temperature, depending on the current surface temperature of the fixing member. Thus, the fixing member may be overheated and high-temperature offset and other defects may occur when the heating operation of the external heating member by the first heating device is controlled based on the surface temperature of the external heating member, as detected by the first temperature-detecting device, and the controlled target temperature of the external heating member.

In the foregoing arrangement of the present invention, the control section controls the heating operation of the first heating device based on (i) the first comparison result, which is the result of comparison between the temperature detected by the first temperature-detecting device and the pre-set controlled target temperature of the external heating member, and (ii) the second comparison result, which is the result of comparison between the temperature detected by the second temperature-detecting device and the pre-set controlled target temperature of the fixing member. In this way, the temperature of the external heating member can be appropriately controlled within the temperature range that allow for a fixing process without causing fixing defects.

An image forming apparatus according to the present invention includes the foregoing fixing apparatuses. Thus, the temperature of the external heating member provided for the fixing member can be accurately controlled to maintain the temperature of the fixing member in a suitable range.

In order to achieve the foregoing object, the present invention provides a temperature control method for a fixing apparatus that includes: a fixing member; a pressing member; and an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, the method including: a first temperature-detecting step of detecting a surface temperature of the external heating member; a second temperature-detecting step of detecting a surface temperature of the fixing member; a first comparing step of comparing a detected temperature in the first temperature-detecting step with a controlled target temperature of the external heating member; a second comparing step of comparing a detected temperature in the second temperature-detecting step with a controlled target temperature of the fixing member; and a first control step for controlling a heating operation of the first heating device based on results of comparisons in the first comparing step and the second comparing step.

According to a temperature control method of the present invention, the heating operation of the first heating device is controlled based on results of comparisons in the first comparing step and the second comparing step. In this way, the temperature of the external heating member can be accurately controlled to maintain the temperature of the fixing member within a suitable range.

The control section of the fixing apparatus may be realized by a computer. In this case, the present invention includes a temperature control program for causing a computer to operate as the control section, and a computer-readable storage medium storing such a program.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 12(*b*) is an explanatory drawing illustrating a structure of a release/contact section provided in the fixing apparatus according to another embodiment of the present invention, in which the external heating section is separated from the fixing roller.

DESCRIPTION OF THE EMBODIMENTS

First Embodiment

Figure 2:
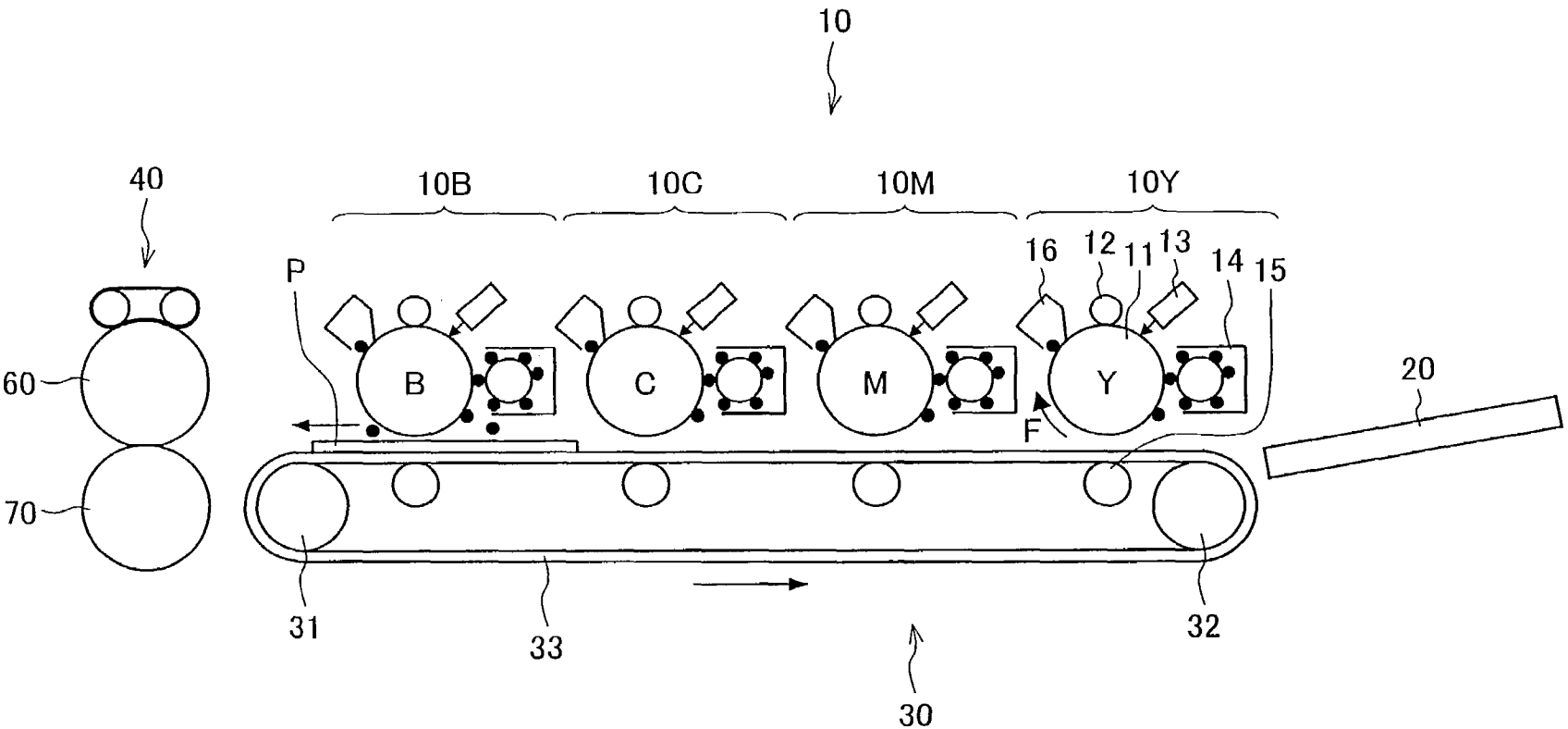
FIG. 2 is an explanatory drawing showing a schematic structure of an image forming apparatus provided with the fixing apparatus according to one embodiment of the present invention.

The following will describe one embodiment of the present invention. First, description is made as to an image forming apparatus 1 equipped with a fixing apparatus 40 of the present embodiment. FIG. 2 is an explanatory drawing schematizing a structure inside the image forming apparatus 1. The image forming apparatus 1 is a color image forming apparatus of a dry electrophotographic type, in which a color and monochromatic images are formed on predetermined printing paper based on image data, which is, for example, either transmitted from terminals on a network, or read out by an image reading apparatus (not shown).

As shown in FIG. 2, the image forming apparatus 1 includes visualized image forming units 10 (10Y, 10M, 10C, 10B), printing paper transporting means 30, and a fixing apparatus 40.

The visualized image forming units 10 are composed of four visualized image forming units 10Y, 10M, 10C, and 10B, which are disposed side by side and respectively corresponding to colors of yellow (Y), magenta (M), cyan (C), and black (B). The visualized image forming units 10Y, 10M, 10C, and 10B respectively form images using toners of the corresponding colors yellow (Y), magenta (M), cyan (C), and black (B). The visualized image forming units 10Y, 10M, 10C, and 10B are disposed along a transport path that carries a printing paper P from a paper feed tray 20 to the fixing apparatus 40, so that the toners of the respective colors are transferred one over another on the printing paper P as it is transported (known as the tandem method).

The visualized image forming units 10Y, 10M, 10C, and 10B have essentially the same structure, each including a photoreceptor drum 11, a charger 12, a laser beam irradiating means 13, a developing unit 14, a transfer roller 15, and a cleaner unit 16.

The photoreceptor drum 11 is a drum-like roller having a photosensitive material on its surface. The photoreceptor drum 11 is rotated in a direction of arrow F. The charger 12 uniformly charges the surface of the photoreceptor drum 11 to a predetermined potential.

The laser beam irradiating means 13 exposes the surface of the photoreceptor drum 11 according to image data, after the surface of the photoreceptor drum 11 has been charged by the charger 12. This forms an electrostatic latent image on the surface of the photoreceptor drum 11. In the visualized image forming units 10Y, 10M, 10C, and 10B, the laser beam irradiating means 13 receive pixel signals respectively corresponding to an yellow component, a magenta component, a cyan component, and a black component of the image data. Based on the image data, each laser beam irradiating means 13 exposes the charged surface of the photoreceptor drum 11 and forms an electrostatic latent image.

The developing unit 14 forms a toner image with toner, by developing the electrostatic latent image formed on the surface of the photoreceptor drum 11. The developing units 14 of the visualized image forming units 10Y, 10M, 10C, and 10B include toners (developers) of yellow, magenta, cyan, and black, respectively. The toner develops the electrostatic latent image formed on the photoreceptor drum 11, with the result that a toner image (developed image) is formed. The developer may be a non-magnetic one-component developer (non-magnetic toner), a non-magnetic two-component developer (non-magnetic toner and carrier), or a magnetic developer (magnetic toner), for example.

The transfer roller 15 has a bias voltage of the polarity opposite to that of the toner, so that the toner image formed on the photoreceptor drum 11 is transferred onto the printing paper P as it is transported by the printing paper transporting means 30. In the visualized image forming units 10Y, 10M, 10C, and 10B, each transfer roller 15 has been applied with a bias voltage of the polarity opposite to that of the toner. By applying the bias voltage to the printing paper P, the toner image on the photoreceptor drum 11 is transferred onto the printing paper P.

In the visualized image forming units 10Y, 10M, 10C, and 10B, the cleaner unit 16 removes and collects toner remaining on the surface of the photoreceptor drum 11, after the developing process by the developing unit 11 and the transfer process by the transfer roller 15 have been finished. The transfer of the toner image onto the printing paper P is performed for each color and is therefore repeated four times.

The printing paper transporting means 30 includes a driving roller 31, an idling roller 32, and a transport belt 33. The printing paper transporting means 30 transports the printing paper P so that a toner image is formed thereon by the visualized image forming units. The driving roller 31 and the idling roller 32 suspend the transport belt 33 (an endless belt). The transport belt 33 rotates by the rotation of the driving roller 31, which is rotated at a predetermined peripheral velocity. The transport belt 33 has static electricity on an outer surface, so that the printing paper P is transported by being electrostatically attracted thereto. Further, the outer surface of the transport belt 33 is charged to a predetermined potential, which also electrostatically attracts the printing paper P for transport.

The printing paper P that has been transported by the printing paper transporting means 30, and passed through the visualized image forming units 10Y, 10M, 10C, and 10B with a transferred toner image (unfixed toner image) thereon is stripped from the transport belt 33 by the curvature of the driving roller 31 and transported to the fixing apparatus 40. The toner image transferred onto the printing paper P by the visualized image forming units 10Y, 10M, 10C, and 10B has not been fixed yet.

The unfixed toner image transferred onto the printing paper P is fused onto the printing paper P with heat and pressure. This is performed by the fixing apparatus 40. Specifically, the fixing apparatus 40 includes a fixing roller (fixing member) 60 that is heated to a predetermined temperature, and a pressing roller (pressing member) 70 that is pressed against the fixing roller 60 with an elastic member such as a spring. The printing paper P that has been transported by the printing paper transporting means 30 at a predetermined transport speed (processing speed of 355 mm/s for the monochromatic mode, and 175 mm/s for the color mode), and a predetermined copying speed (70 sheets/minute for the monochromatic mode, and 40 sheets per minute for the color mode, for example, in crossfeeding of A4 size papers) is sent to a fixing nip portion (a nip area between the fixing roller 60 and the pressing roller 70) formed between the fixing roller 60 and the pressing roller 70. In this manner, the printing paper P with the unfixed toner thereon is fed to the nip area (fixing nip portion) between the fixing roller 60 and the pressing roller 70. The heat on the periphery of the fixing roller 60 melts the toner, and an image is fused (fixed) on the surface of the printing paper P by the pressure of the fixing roller 60 and the pressing roller 70. As a result, the toner image on the printing paper P is firmly fixed on the printing paper P.

Note that, the image forming apparatus 1 is operable in the color mode (multi-color mode) in which color images (multi-color images) are formed by transferring images on the printing paper P using the visualized image forming units 10Y, 10M, 10C, and 10B, and in the monochromatic mode (black-and-white mode) in which monochromatic images are formed by transferring an image on the printing paper P using only the visualized image forming unit 10B. More specifically, a main control member (a control integrated circuit board or a computer, not shown) provided in the image forming apparatus 1 selects the color mode or monochromatic mode according to user instructions, and controls the visualized image forming units 10Y, 10M, 10C, and 10B to perform image formation according to the selected mode.

Further, the main control member controls the printing paper transporting means (printing paper transporting section 30, fixing roller 60, pressing roller 70, etc.) of the image forming apparatus 1 such that the printing paper P is transported at a transport speed (also referred to as a processing speed) of 170 mm/s in the color mode, and 350 mm/s in the monochromatic mode. This realizes a continuous paper feed of 40 sheets/minute in the color mode, and 70 sheets/minute in the monochromatic mode.

Figure 1:
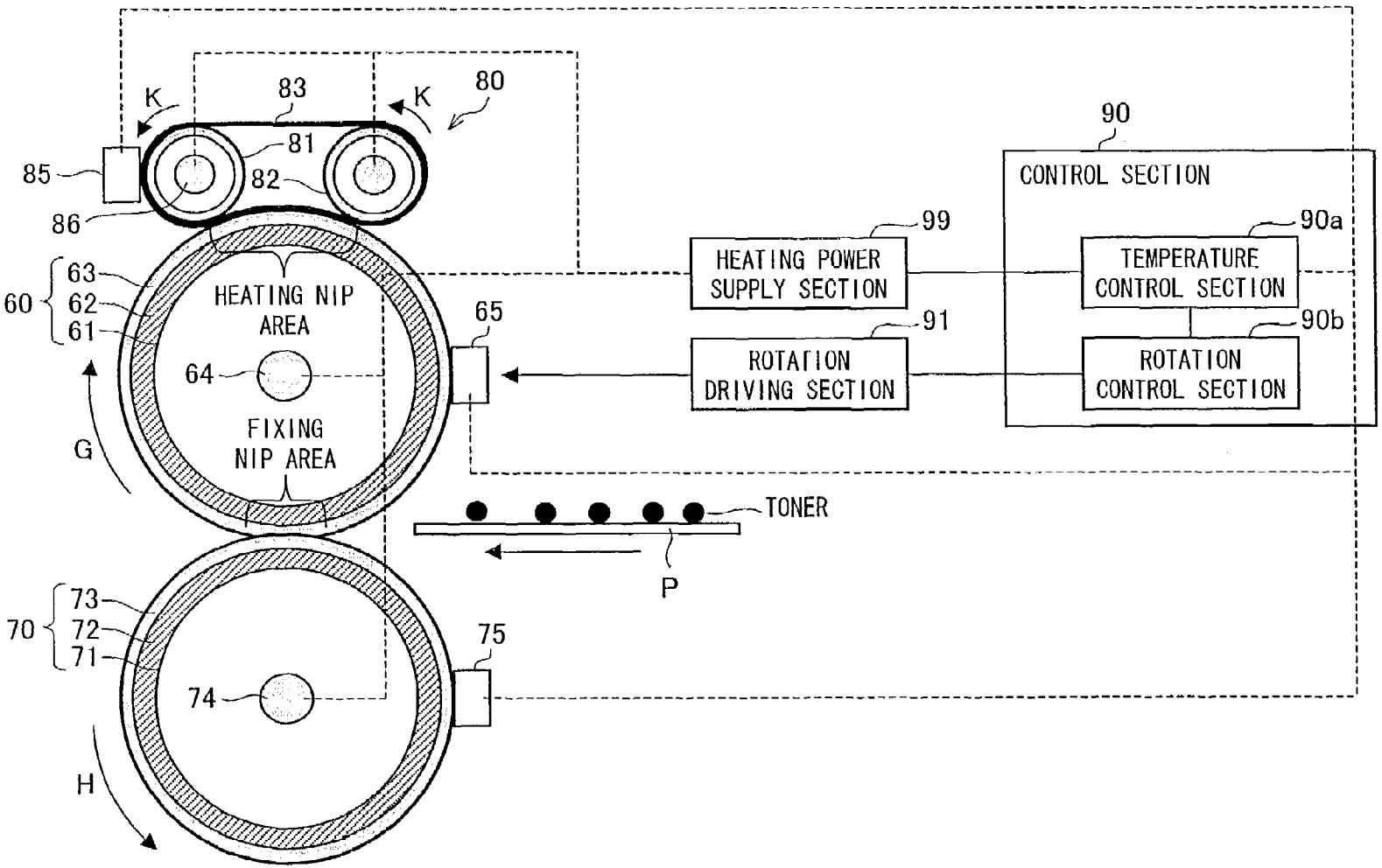
FIG. 1 is a diagram showing a schematic structure of a fixing apparatus according to one embodiment of the present invention.

With reference to FIG. 1, the following describes the fixing apparatus 40 in more detail. FIG. 1 is a diagram schematizing a structure of the fixing apparatus 40. As shown in FIG. 1, the fixing apparatus 40 includes: an external heating section 80, a control section (control member) 90, and a rotation driving section (driving section) 91, in addition to the fixing roller (fixing member) 60 and the pressing roller (fixing member) 70.

The rotation driving section 91 drives the fixing roller 60 to rotate, and is realized by a motor, for example. Operations of the rotation driving section 91 are controlled by the control section 90.

The fixing roller 60 rotates in a direction of G shown in FIG. 1. The fixing roller 60 includes: a metal core 61, which is a hollow metal cylinder; an elastic layer 62 covering the periphery of the metal core 61; and a releasing layer 63 covering the elastic layer 62.

The metal core 61 is an aluminum cylinder with an outer diameter of 46 mm. The material of the metal core 61 is not just limited to aluminum, and iron or stainless steel may be used, for example. The elastic layer 62 is a heat-resistant silicon rubber (JIS-A hardness 20) with a thickness of 3 mm. The releasing layer 63 is a PFA tube (co-polymer of tetrafluoroethylene and perfluoroalkylvinylether) with a thickness of about 30 μm. The material of the releasing layer 63 is not particularly limited as long as it is heat resistant, durable, and provides good release from toner. Other than PFA, various fluoro materials such as PTFE (polytetrafluoroethylene) may be used, for example. The fixing roller 60 having such a construction has an outer diameter of 50 mm and a surface hardness of 68 (Asker C). The surface width of the fixing roller 60 in the axial direction is 320 mm.

The periphery of the fixing roller 60 is in contact with a thermistor (temperature-detecting element, temperature-detecting device) 65 for detecting a temperature on the periphery of the fixing roller 60. Inside the metal core 61, there is provided a halogen lamp 64 that radiates heat in response to supplied power. The halogen lamp 64 is the heat source of the fixing roller 60. In response to supplied power, the halogen lamp 64 heats inside the fixing roller 60 to a predetermined temperature. This heats the printing paper P as it passes the fixing nip portion N with the unfixed toner image.

In the present embodiment, only one halogen lamp is installed. However, the present invention is not just limited to such an example, and a plurality of halogen lamps with divided heat distributions along the axial direction may be used so that an optimum temperature distribution can be formed for each different paper size. Further, in the present embodiment, the thermistor 65 is disposed in contact with a middle portion in a longitudinal direction (perpendicular to the paper feed direction) of the fixing roller 60. However, the present invention is not just limited to such an example, and the thermistor 65 may be disposed at end portions (non paper feed regions) in the longitudinal direction of the fixing roller 60. For example, when two halogen lamps are provided and so amounts of heat are different at the middle portion and an end portion in the longitudinal direction of the fixing roller 60, the thermistor 65 may be provided at each of these portions. In the case where the temperature control section 90*a* is to control temperature of the external heating section 80 based on the result of temperature detection at the middle portion in the longitudinal direction of the fixing roller 60, the control operation performed by the temperature control section 90*a*, or a structure thereof can be simplified. In the case where the temperature control section 90*a* is to control temperature of the external heating section 80 based on the result of detection at an end portion in the longitudinal direction of the fixing roller 60, it is possible to prevent a temperature rise at an end portion (non-paper feed portion) of the fixing roller 60, which might occur when feeding a small size paper. In the case where the temperature control section 90*a* is to control temperature of the external heating section 80 based on the result of temperature detection at both the middle portion and the end portion in the longitudinal direction of the fixing roller 60, temperature along the longitudinal direction (axial direction) of the fixing roller 60 can be controlled more accurately.

The pressing roller 70 rotates in a direction of H shown in FIG. 1, and includes: a metal core 71, which is a hollow metal cylinder; an elastic layer 72 covering the periphery of the metal core 71, and a releasing layer 73 covering the elastic layer 72.

The metal core 71 is an aluminum cylinder with an outer diameter of 46 mm. The material of the metal core 71 is not just limited to aluminum, and iron or stainless steel may be used, for example. The elastic layer 72 is a heat-resistant silicon rubber with a thickness of 2 mm. The releasing layer 73 is a PFA tube with a thickness of about 30 μm. The material of the releasing layer 73 is not particularly limited as long as it is heat resistant, durable, and provides good release from toner. Other than PFA, various fluoro materials such as PTFE may be used, for example. The fixing roller 70 having such a construction has an outer diameter of 50 mm and a surface hardness 75 (Asker C).

The pressing roller 70 is pressed against the fixing roller 60 under a predetermined load exerted by an elastic member such as a spring (not shown). As a result, a fixing nip portion N (for example, a width of 8.5 mm in a direction of transport of the printing paper) is formed between the periphery of the fixing roller 60 and the periphery of the pressing roller 70. By the rotation of the fixing roller 60, the pressing roller 70 rotates in the reverse direction. (The directions of rotation are the same at the fixing nip portion.) In the present embodiment, the pressing roller 70 follows the rotation of the fixing roller 60. However, the present invention is not just limited to such an example, and the pressing roller 70 and the fixing roller 60 may be independently driven by different rotation driving means.

The periphery of the pressing roller 70 is in contact with a thermistor 75 for detecting a temperature on the periphery of the pressing roller 70. Inside the metal core 71, there is provided a halogen lamp (heater lamp) 74 that radiates heat in response to supplied power. The halogen lamp 74 is the heat source of the pressing roller 70. In response to supplied power, the halogen lamp 74 heats inside the pressing roller 70 to a predetermined temperature.

In the present embodiment, the pressing roller 70 has a rubber hardness of 75, greater than that of the fixing roller 60 (rubber hardness of 68). This is to create a "reversed" fixing nip portion N between the pressing roller 70 and the fixing roller 60 (the fixing roller 60 being slightly deformed inward while the shape of the pressing roller 70 remain substantially unchanged). By the "reversed" fixing nip portion N, the printing paper P past the fixing nip portion N is ejected along the periphery of the pressing roller 70. In this way, the printing paper P is easily stripped when it is ejected through the fixing nip portion N (i.e., without requiring any forced stripping assisting means such as a stripping claw; rather, the printing paper P is stripped by virtue of its stiffness). When the pressing roller 70 has a smaller surface hardness than that of the fixing roller 60, the pressing roller 70 slightly deforms inward at the fixing nip portion N while the shape of the fixing roller 60 remain substantially unchanged. This causes the printing paper P past the fixing nip portion N to be ejected along the periphery of the fixing roller 60. In this case, the printing paper P is not easily stripped.

The external heating section 80 includes a first support roller (first heat roller) 81, a second support roller (second heat roller) 82, and an endless belt (external heat belt) 83. The endless belt 83 is suspended by the first and second heat rollers 81 and 82 such that the rear surface (inner periphery) of the endless belt 83 is in contact with the peripheries of the first and second support rollers 81 and 82. The endless belt 83 is provided on the upstream side of the fixing nip portion with respect to the fixing roller 60, and is pressed against the fixing roller 60 under a predetermined pressure. As a result, there is formed a heating nip portion between the endless belt 83 and the fixing roller 60 (a nip area between the endless belt 83 and the fixing roller 60, 20 mm in length along the periphery direction of the fixing roller 60 in the present embodiment). In the present embodiment, the endless belt 83 is suspended by the two support rollers. However, the present invention is not just limited to such an example, and more than two support rollers may be used to suspend the endless belt 83, for example, by providing an additional tension roller as required.

The endless belt 83 is in contact with the periphery of the fixing roller 60, so that the endless belt 83 rotates when the fixing roller 60 rotates. By the rotation of the endless belt 83, the first and second support rollers 81 and 82 rotate in the reverse direction (direction of K shown in FIG. 1) of the rotation of the fixing roller 60. More specifically, when the fixing roller 60 rotates under the control of the control section 90 controlling the rotation driving section 91 of the fixing roller 60, the endless belt 83 is moved by the frictional force generated at the nip area in contact with the fixing roller 60. As a result, the first and second support rollers 81 and 82, and the endless belt 83 rotate.

The endless belt 83 is a belt member in which a PTFE, 10 μm thick, is coated as a releasing layer on a 90 μm thick polyimide base. However, the material and thickness of the endless belt 83 are not limited to these examples. For example, the endless belt 83 may be a belt member made of metal such as nickel, stainless steel, or iron. The material of the releasing layer is not particularly limited as long as it is heat resistant, durable, and provides good release from toner. For example, PFA, or a mixture of PFA and PTFE may be used.

The first and second support rollers 81 and 82 are each made out of an aluminum metal core with an outer diameter of 15 mm and a thickness of 1 mm. As required, a releasing layer may optionally be provided on the metal core when, for example, the frictional force between the inner surface of the belt and the first and second support rollers 81 and 82 needs to be decreased and thereby reduce the skew force caused by wobbling. The material of the releasing layer is not particularly limited as long as it is heat resistant, durable, and provides good release from toner. For example, PFA, PTFE (polytetrafluoroethylene), or other types of fluoro materials may be used.

The first and second support rollers 81 and 82 are pressed against the periphery of the fixing roller 60 via the endless belt 83 under a predetermined pressure exerted by an elastic member such as a spring (not shown). By the pressure, the surface of the endless belt 83 is in contact with the periphery of the fixing roller 60. This creates a nip portion between the surface of the endless belt 83 and the periphery of the fixing roller 60. The nip width (heat nip width) between the surface of the endless belt 83 and the periphery of the fixing roller 60 is 20 mm (along the periphery direction of the fixing roller 60).

A thermistor (temperature-detecting element, temperature-detecting device) 85 for detecting a surface temperature of the endless belt 83 is in contact with the outer surface of the endless belt 83 at a nip area in contact with the first support roller 81. Inside the first support roller 81, there is provided a halogen lamp (first heat source section, first heating device) 86 that radiates heat in response to supplied power. The halogen lamp 86 is the heat source of the endless belt 83. In response to supplied power, the halogen lamp 86 radiates heat and heats the endless belt 83 via the first support roller 81. The endless belt 83 is externally in contact with the periphery of the fixing roller 60, enabling the periphery of the fixing roller 60 to be heated at the nip area. In the present embodiment, the temperature of the endless belt 83 can be quickly raised because the two support rollers 81 and 82 are thin and small, and the endless belt 83 is thin.

Note that, in the present embodiment, the first and second support rollers 81 and 82 have the same shape and use the same heat source, and as such there is provided only one temperature-detecting element (thermistor) to control a surface temperature of the endless belt 83. However, the present invention is not just limited to such an example. For example, the first and second support rollers 81 and 82 may have different shapes, and a heat source may be provided for each of the first and second support rollers 81 and 82. In this case, more than one thermistor may be provided to independently detect temperature of the first and second support members 81 and 82.

The control section 90 is a control integrated circuit board that controls a power supply to the halogen lamps 64, 74, and 86, and the rotation of the fixing roller 60, among other things. In addition to the temperature control section 90*a*, the control section 90 includes a rotation control section 90*b*.

The temperature control section 90*a* is connected to the thermistors 65, 75, 85, and a heating power supply section (power supply device) 99. The heating power supply section 99 is connected to the halogen lamps 64, 74, and 86 to supply power which the halogen lamps 64, 74, and 86 use to generate heat. Based on the results of temperature detection by the thermistors 65, 75, and 85, the image formation mode, and the number of continuous feeds, the temperature control section 90*a* switches power that is supplied to each halogen lamp by the heating power supply section 99. In this way, the temperature control section 90*a* controls the amount of heat generated by each halogen lamp, and thereby controls temperatures of the endless belt 83, the fixing roller 60, and the pressing roller 70 at predetermined temperatures.

The rotation control section 90*b* is connected to the rotation driving section 91, which drives the fixing roller 60 to rotate. By controlling operations of the rotation driving section 91, the rotation control section 90*b* controls the rotational speed of the fixing roller 60.

Table 1 below represents results of a fixing process performed at different fixing temperatures (surface temperatures of the fixing roller 60) in the monochromatic mode (processing speed 350 mm/s) and the color mode (processing speed 170 mm/s), using the image forming apparatus 1 having the foregoing structure. In the present embodiment, fixability was evaluated as follows. A sample (printing paper) after the fixing process was gently folded inward on the printed side, and a predetermined weight (1 kgf) was rolled over the fold line. The printing paper was spread out and the toner on the fold line was swabbed with a clean cloth to see extent of toner exfoliation. The evaluation was made according to the following criteria:

Excellent: No toner exfoliation (excellent fixing strength)

Good: Toner exfoliated over a width less than 0.6 mm (fixing is weak but acceptable)

Bad: Toner exfoliated over a width of 0.6 mm or greater (unacceptable fixing strength (fixing defect))

Poor: High-temperature offset

TABLE 1

| | Fixing temperature (Degrees Celsius) | | | | | | | |
|---|---|---|---|---|---|---|---|---|
| | 150 | 160 | 175 | 180 | 190 | 195 | 210 | 220 |
| Monochromatic mode | — | — | Bad | Good | Exlnt. | Exlnt. | Exlnt. | Poor |
| Color mode | Bad | Good | Exlnt. | Exlnt. | Exlnt. | Poor | — | — |

As can be seen from Table 1, in the monochromatic mode, there was a fixing defect and the fixing strength was insufficient at fixing temperatures below 180° C. At fixing temperatures above 210° C., a high-temperature offset occurred. In the color mode, a fixing defect occurred below 160° C., and a high-temperature offset occurred above 190° C. That is, the non-offset range (temperature range that can fix toner without causing offset or other fixing defects) was 180° C. to 210°, inclusive, in the monochromatic mode, and 160° C. to 190° C., inclusive, in the color mode. That is, a common non-offset range for the monochromatic mode and color mode was 180° C. to 190° C., inclusive.

In light of these results, in the present embodiment, the controlled temperatures (target temperatures) of the endless belt 83, the fixing roller 60, and the pressing roller 70 in a standby state were set to 205° C., 185° C., and 150° C., respectively. The controlled temperatures of the endless belt 83, the fixing roller 60, and the pressing roller 70 when feeding paper in the monochromatic mode were set to 220° C., 185° C., and 150° C., respectively. The controlled temperatures of the endless belt 83, the fixing roller 60, and the pressing roller 70 when feeding paper in the color mode were set to 205° C., 180° C., and 150° C., respectively. Note that, the controlled temperature of the endless belt 83 when feeding paper is appropriately set so that, for example, the surface temperature of the fixing roller 60 during a continuous paper feed does not fall below the non-offset range or stays at the controlled temperature.

Figure 3:
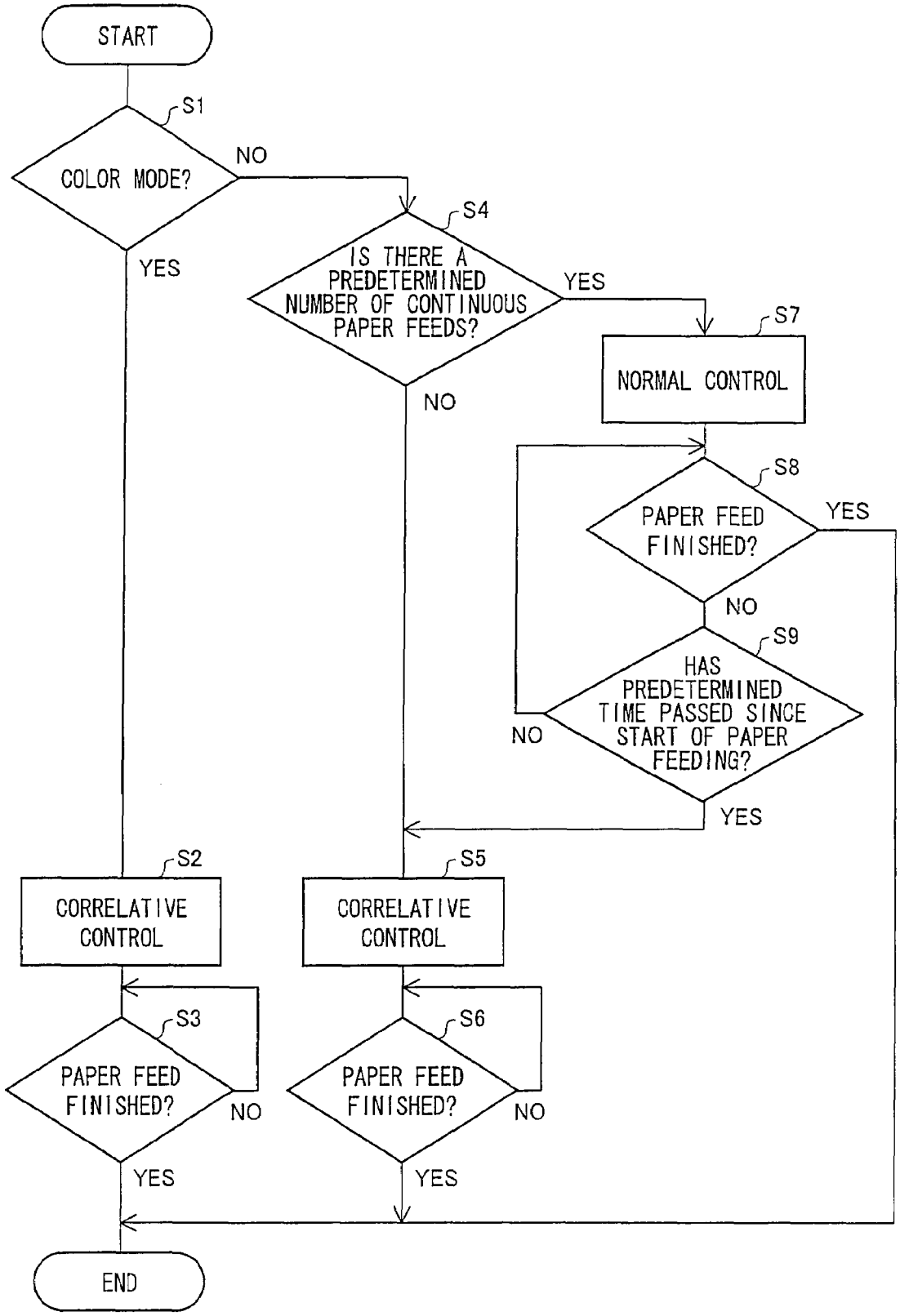
FIG. 3 is a flowchart representing processes performed by the fixing apparatus according to one embodiment of the present invention.

The following specifically describes the process performed by the control section 90 (temperature control section 90*a*). FIG. 3 is a flowchart representing the process performed by the control section 90.

First, the temperature control section 90*a* determines whether the current mode is the color mode or monochromatic mode based on information, indicative of the image formation mode (color mode or chromatic mode) and the number of continuous feeds (the number of copies), supplied from the main control section (S1). The number of copies and the image formation mode are entered by a user, for example, through an operation panel (not shown) provided in the image forming apparatus 1, or through an input screen of a printer driver at a host computer communicably connected to the image forming apparatus 1. The image formation mode may be set by automatically determining the type of document, as will be described later.

If the current mode is determined to be the color mode in S1, the temperature control section 90*a* performs a fixing process according to correlative control (first control) (S2), as described below. In S3, it is decided whether the scheduled number of papers have been fed. If Yes, the process assumes a standby state and the process is finished.

As used herein, the correlative control refers to a control method in which the temperature of the halogen lamp 86 provided in the external heating section 80 is controlled based on a result of comparison of detected temperature and controlled temperature, which is independently performed for the endless belt 83 and the fixing roller 60. More specifically, the halogen lamp 86 provided in the external heating section 80 is turned on only when the detected temperatures of the fixing roller 60 and the endless belt 83 have not reached the controlled temperatures. If not, the halogen lamp 86 is turned off. As to the control of the halogen lamp 64 provided in the fixing roller 60, the halogen lamp 64 is turned on when the detected temperature of the fixing roller 60 is below the controlled temperature. The halogen lamp 64 is turned off when the detected temperature of the fixing roller 60 is above the controlled temperature.

If the current mode is determined to be the monochromatic mode in S1, the temperature control section 90*a* determines whether the number of continuous feeds exceed a predetermined number (S4). The predetermined number is suitably set according to the type (size, material, etc.) of the printing paper used, or properties of the toner used, so that the surface temperature of the fixing roller 60 can be varied within the non-offset range. For example, a table of correspondence between predetermined numbers and types (size, material, etc.) of printing paper or properties of toner, or a conversion formula therefor, is stored in a storing means provided in the control section 90, and the temperature control section 90*a* obtains information regarding the type of printing paper or the type (property) of toner used. A predetermined number can then be determined from the table or conversion formula, based on the information obtained by the temperature control section 90*a*.

If it is decided in S4 that the number of continuous feeds is below the predetermined number, the temperature control section 90*a* performs the fixing process according to correlation control (first control) (S5), and decides whether a scheduled number of papers have been fed (S6). If Yes in S6, the process assumes a standby state and the process is finished.

If it is determined in S4 that the number of continuous feeds is above the predetermined number, the temperature control section 90*a* starts the fixing process according to normal control (second control) (S7), and decides whether a scheduled number of papers have been fed (S8). If Yes in S8, the process assumes a standby state and the process is finished. If No in S8, the temperature control section 90*a* determines whether a predetermined amount of time has passed from the start of feeding (S9). If No in S9, the fixing process by normal control is continued and the sequence goes to S8. If Yes in S9, the process is switched to the correlative control and the sequence goes to S5.

As used herein, the normal control refers to the process in which the halogen lamp 64 provided inside the fixing roller 60 is controlled based on the detected temperature of the fixing roller 60 (surface temperature of the fixing roller 60 as detected by the thermistor 65), and the controlled temperature (target temperature) of the fixing roller 60, and in which the halogen lamp 86 provided for the external heating section 80 is controlled based on the detected temperature of the endless belt 83 (surface temperature of the endless belt 83 as detected by the thermistor 85), and the controlled temperature of the endless belt 83. More specifically, for the temperature control of the external heating section 80 for example, the halogen lamp 86 is turned on when the temperature of the endless belt 83 as detected by the thermistor 85 is below or has not reached the controlled temperature, and is turned off when it is above or has reached the control temperature. As for the fixing roller 60, the halogen lamp 64 is turned on when the temperature of the fixing roller 60 as detected by the thermistor 65 is below or has not reached the controlled temperature, and is turned off when it is above or has reached the controlled temperature.

That is, the normal control differs from the correlative control in that the halogen lamp 86 is turned on when the detected temperature of the fixing roller 60 has reached the controlled temperature and the detected temperature of the endless belt 83 has not reached the controlled temperate, whereas, in the correlative control, the halogen lamp 86 is turned off under these conditions.

The predetermined amount of time is, for example, the time required for the detected temperature of the fixing roller 60, which after the start of feeding increases above the controlled temperature by the heat of the external heating section 80 operated under the normal control, to fall below the controlled temperature as the heat is lost by the continuous paper feed of printing papers. In the foregoing, S9 is performed based on the amount of time passed after the start of feeding. However, this may be made, for example, based on the number of feeds, or the detected temperature of the fixing roller 60.

EXAMPLE 1

The following describes results of experiment that was performed to examine how changes in surface temperature of the fixing roller 60 influence fixability. The experiment was performed by forming (printing) images with the image forming apparatus 1, (i) by continuously feeding printing paper P that has an unfixed image (unfixed toner image) thereon, and (ii) by making a small number of prints in an intermittent mode, starting from a standby state. As used herein, the intermittent mode refers to the mode of operation repeating a cycle of feeding a single sheet of printing paper and pausing the feeding for about 4 seconds. The experiment was performed in the monochromatic mode and the color mode. Table 2 through Table 5 show conditions of experiment.

As shown in Table 2, the processing speed and the copying speed (sheets/minute in the crossfeed (direction of paper feed perpendicular to the long side) of A4 size paper) were 350 mm/s and 70 sheets/min for the monochromatic mode, and 170 mm/s and 40 sheets/min for the color mode.

TABLE 2

| | Processing speed (mm/s) | Copying speed (sheets/min) |
|---|---|---|
| Monochromatic mode | 350 | 70 |
| Color mode | 170 | 40 |

Table 3 shows controlled temperatures (target temperatures) of the endless belt 83, the fixing roller 60, and the pressing roller 70 during standby and feeding in the both image formation modes. As shown in Table 3, the controlled temperatures of the endless belt 83, the fixing roller 60, and the pressing roller 70 during standby were 205° C., 185° C., and 150° C., respectively. The controlled temperatures of the endless belt 83, the fixing roller 60, and the pressing roller 70 during feeding in the monochromatic mode were 220° C., 185° C. and 150° C., respectively. The controlled temperatures of the endless belt 83, the fixing roller 60, and the pressing roller 70 during feeding in the color mode were 205° C., 180° C. and 150° C., respectively.

TABLE 3

| | | Endless belt 83 | Fixing roller 60 | Pressing roller 70 |
|---|---|---|---|---|
| Controlled temperature during standby (Degrees Celsius) | | 205 | 185 | 150 |
| Controlled temperature during feeding (Degrees Celsius) | Monochromatic mode | 220 | 185 | 150 |
| | Color mode | 205 | 180 | 150 |

Table 4 represents the second control (normal control) performed in the experiment. In the normal control performed in this Example, the halogen lamp 64 provided inside the fixing roller 60 was controlled based on the detected temperature and controlled temperature of the fixing roller 60, and the halogen lamp 86 provided for the external heating section 80 was controlled based on the detected temperature and controlled temperature of the endless belt 83. Taking the temperature control of the external heating section 80 as an example, the halogen lamp 86 was turned on when the temperature of the endless belt 83 as detected by the thermistor 85 was below or has not reached the controlled temperature, and was turned off when it was above or has reached the controlled temperature. As for the fixing roller 60, the halogen lamp 64 was turned on when the temperature of the fixing roller 60 as detected by the thermistor 65 was below or has not reached the controlled temperature, and was turned off when it was above or has reached the controlled temperature.

TABLE 4

| | Temperature of endless belt 83 | | | |
|---|---|---|---|---|
| | Below controlled temperature | At or above controlled temperature | Below controlled temperature | At or above controlled temperature |
| | Temperature of fixing roller 60 | | | |
| | Below controlled temperature | Below controlled temperature | At or above controlled temperature | At or above controlled temperature |
| Halogen lamp 86 | ON | OFF | ON | OFF |
| Halogen lamp 64 | ON | ON | OFF | OFF |

Table 5 represents the first control (correlative control) performed in the experiment. In the correlative control performed in this Example, the halogen lamp 86 provided for the external heating section 80 was turned on only when the detected temperatures of both the fixing roller 60 and the endless belt 83 have not reached the controlled temperature. If not, the halogen lamp 86 was turned off. As for the control of the halogen lamp 64 provided in the fixing roller 60, the halogen lamp 64 was turned on when the detected temperature of the fixing roller 60 was below the controlled temperature, and was turned off when it was above the controlled temperature, as in the normal control described based on Table 4. That is, the normal control differs from the correlative control in that the halogen lamp 86 provided for the external heating section 80 is turned on when the detected temperature of the fixing roller 60 has reached the controlled temperature and the detected temperature of the endless belt 83 has not reached the controlled temperate, whereas, in the correlative control, the halogen lamp 86 is turned off under these conditions.

TABLE 5

| | Temperature of endless belt 83 | | | |
|---|---|---|---|---|
| | Below controlled temperature | At or above controlled temperature | Below controlled temperature | At or above controlled temperature |
| | Temperature of fixing roller 60 | | | |
| | Below controlled temperature | Below controlled temperature | At or above controlled temperature | At or above controlled temperature |
| Halogen lamp 86 | ON | OFF | OFF | OFF |
| Halogen lamp 64 | ON | ON | OFF | OFF |

Figure 4:
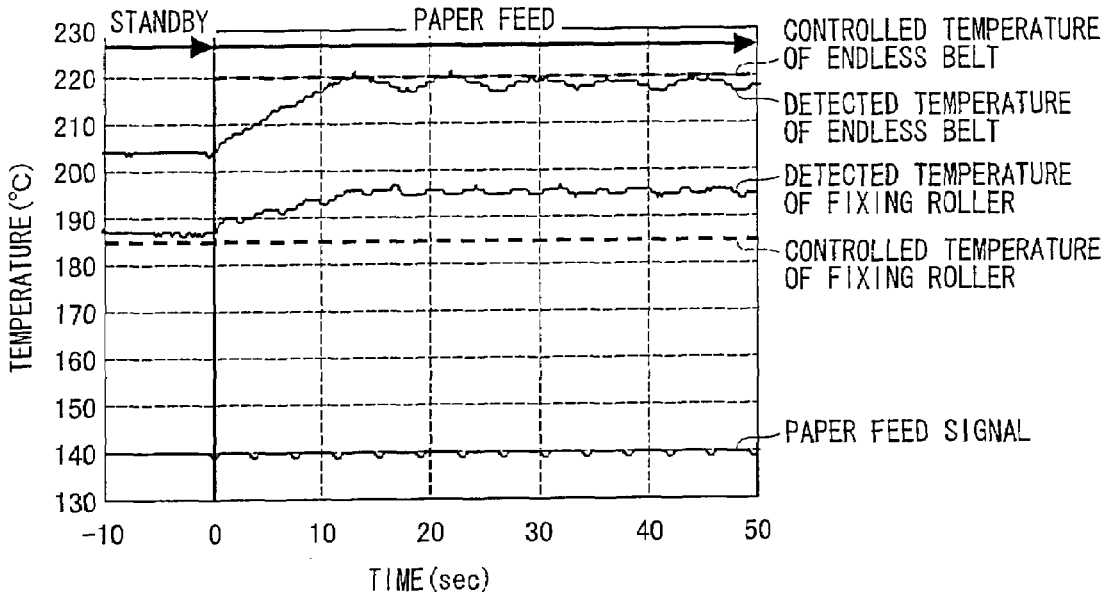
FIG. 4 is a graph representing changes in detected temperature of an endless belt and a fixing roller, when a fixing process in a monochromatic mode was performed intermittently under normal control in the fixing apparatus according to one embodiment of the present invention.

FIG. 4 is a graph representing changes in detected temperature of the endless belt 83 and the fixing roller 60 when the fixing process was performed intermittently under normal control in the monochromatic mode. As shown in FIG. 4, the controlled temperature of the fixing roller 60 remains at 185° C. during standby and feeding. In contrast, the controlled temperature of the endless belt 83, which is 205° C. during standby, jumps to 220° C. during feeding. As a result, the halogen lamp 86 is turned on to raise the temperature of the endless belt 83. The temperature increase of the endless belt 83 raises the temperature of the fixing roller 60 to around 195° C., above the controlled temperature of 185° C. Table 6 represents the result of examination on fixability performed under these conditions.

TABLE 6

| | |
|---|---|
| Sheets | 1 to 13 |
| Fixability | Excellent |

As shown in Table 6, the result of examination on fixability revealed that all of the 13 printing papers that were subjected to the fixing process in the intermittent mode from the standby state had desirable fixing strength.

Figure 5:
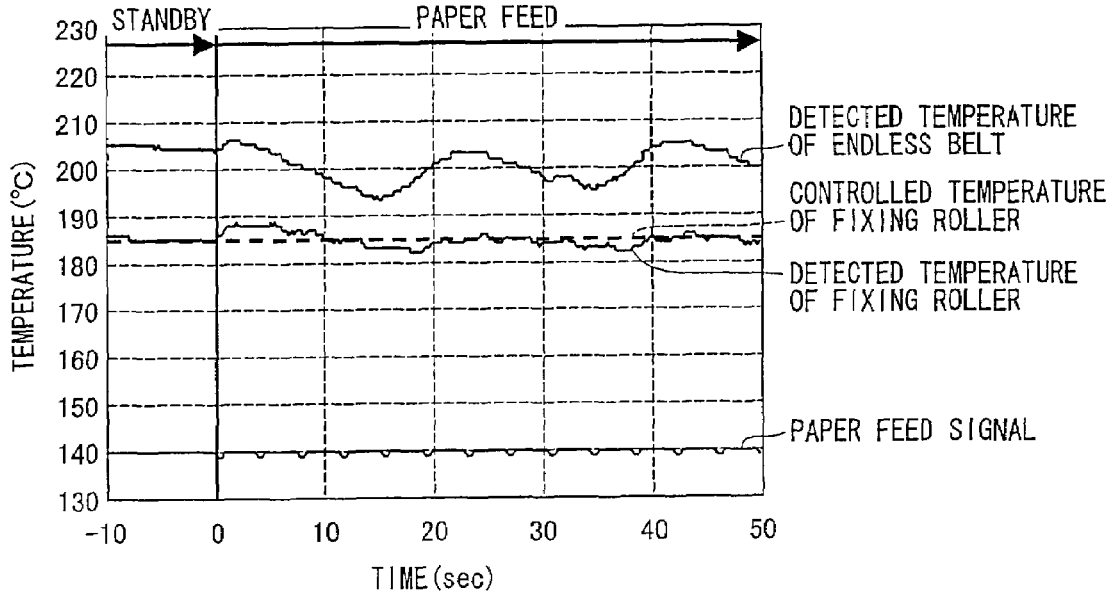
FIG. 5 is a graph representing changes in detected temperature of an endless belt and a fixing roller, when a fixing process in a monochromatic mode was performed intermittently under correlative control in the fixing apparatus according to one embodiment of the present invention.

FIG. 5 is a graph representing changes in detected temperature of the endless belt 83 and the fixing roller 60 when the fixing process was performed intermittently under correlative control in the monochromatic mode. As shown in FIG. 5, at the transition from standby to feeding, the temperature of the endless belt 83 has not reached the controlled temperature (220° C.), whereas that of the fixing roller 60 has reached the controlled temperature (185° C.). As such, the halogen lamps 64 and 86 remain off. The halogen lamps 64 and 86 are turned on when the temperature of the fixing roller 60 falls below the controlled temperature. As a result, the temperature of the fixing roller 60 fluctuates around the controlled temperature of 185° C. Table 7 represents the result of examination on fixability performed under these conditions.

TABLE 7

| | |
|---|---|
| Sheets | 1 to 13 |
| Fixability | Excellent |

As shown in Table 7, the result of examination on fixability revealed that all of the 13 printing papers that were subjected to the fixing process in the intermittent mode from the standby state had desirable fixing strength.

As described above, in the intermittent mode performed in the monochromatic mode, the temperature of the fixing roller 60 fluctuates within the non-offset range (180° C. to 210° C., inclusive) and the fixability does not suffer, regardless of the normal control or correlative control.

However, in the normal control, since the temperature of the fixing roller 60 increases above the controlled temperature, it takes time to lower the temperature to the standby controlled temperature (185° C.), after all the papers have been fed in the monochromatic mode. For example, because of the difficulty in immediately lowering the temperature of the fixing roller 60, the fixing process for color images is performed with the temperature of the fixing roller 60 above the non-offset range of the color mode, when the fixing process in the color mode is started immediately after the fixing process in the monochromatic mode. This causes high-temperature offset. In order to prevent such high-temperature offset, the surface temperature of the fixing roller 60 needs to be allowed to cool below the non-offset range (below 190° C.). This takes time. Further, since unnecessary power is supplied to the halogen lamp 86, power consumption increases.

In contrast, in the correlative control, the temperature of the fixing roller 60 is accurately controlled at the controlled temperature during feeding in the monochromatic mode. As such, the fixing roller 60 is at the standby controlled temperature at the end of feeding. This enables the fixing process in the color mode to be performed immediately after the fixing process in the monochromatic mode, without causing high-temperature offset. Further, since no additional heat is applied during the feeding, power consumption can be reduced.

Thus, when the fixing process is to be performed on a small number of sheets by the intermittent operation in the monochromatic mode, it is preferable to employ correlative control for the temperature control of the fixing roller 60 and the external heating section 80.

Figure 6:
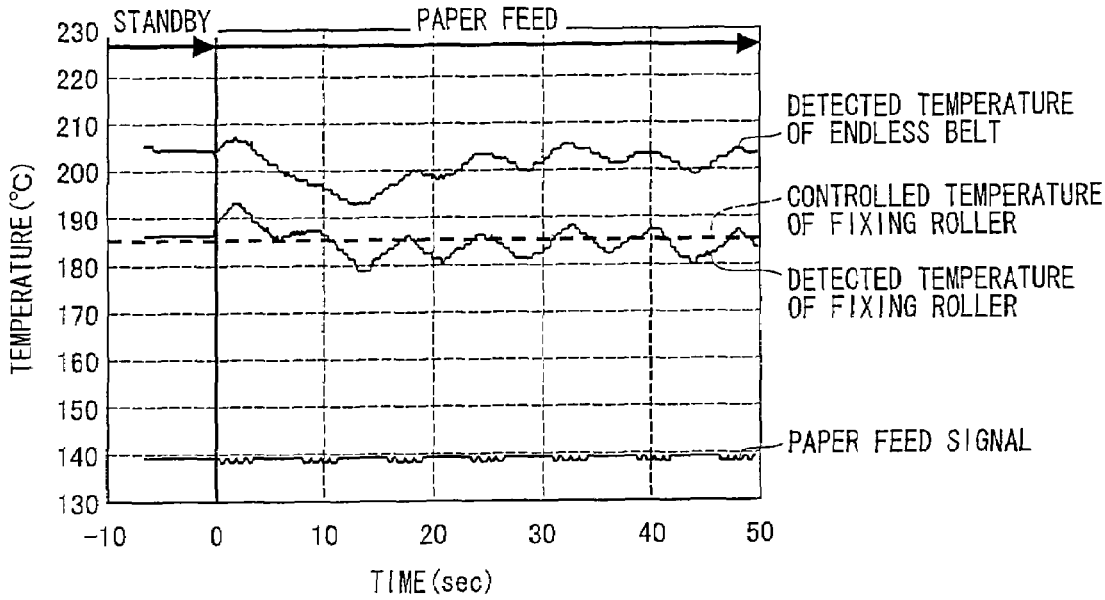
FIG. 6 is a graph representing changes in detected temperature of an endless belt and a fixing roller, when a fixing process in a monochromatic mode was performed under correlative control by continuously and intermittently feeding four sheets in the fixing apparatus according to one embodiment of the present invention.

Table 8 represents results of experiment that was performed to examine how the number of continuous feeds influences fixability, when a small number of sheets (5 sheets in this Example) were fed continuously and intermittently (when a cycle of feeding a small number of sheets and pausing for about 3 seconds was repeated) in a fixing process performed under correlative control in the monochromatic mode. FIG. 6 represents changes in detected temperature of the endless belt 83 and the fixing roller 60 when four sheets of papers were fed continuously and intermittently in a fixing process performed under correlative control in the monochromatic mode.

TABLE 8

| Intermittent operation | Sheets 1-3 | Sheet 4 | Sheet 5 |
|---|---|---|---|
| 1st round | Excellent | Good | Bad |
| 2nd round | Excellent | Good | Bad |
| 3rd round | Excellent | Good | Bad |

As shown in FIG. 6, the temperature of the fixing roller 60 fluctuated within the non-offset range (temperature range that allows for fixing) of the monochromatic mode and fixing was desirable, provided that the number of sheets that was fed continuously and intermittently was four or less.

However, in the fifth sheet, the temperature of the fixing roller 60 fell below the non-offset range and fixing defects occurred. Therefore, in the monochromatic mode, it is preferable that the correlative control be performed when the number of continuous feeds is four or less in a single round of printing, and that the normal control be performed when the number of continuous feeds is five or greater. It should be noted however that the number varies depending upon the type (size, material, etc.) of the printing paper used, or properties of the toner used, etc. It is therefore preferable that the number be suitably set according to such conditions.

Figure 7:
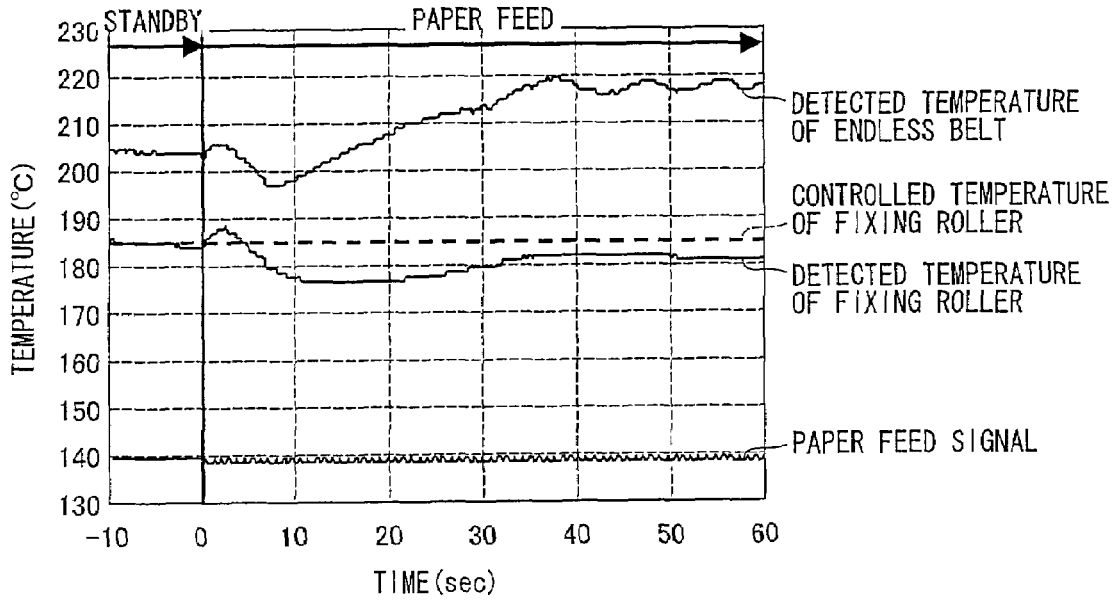
FIG. 7 is a graph representing changes in detected temperature of an endless belt and a fixing roller, when a fixing process in a monochromatic mode was performed under correlative control by continuously feeding sheets from standby in the fixing apparatus according to one embodiment of the present invention.

FIG. 7 is a graph representing changes in detected temperature of the endless belt 83 and the fixing roller 60, when sheets were continuously fed under correlative control in the monochromatic mode, starting from the standby state. As shown in FIG. 7, in a continuous paper feed, the printing papers take a large amount of heat from the fixing roller 60, and as a result the temperature of the fixing roller 60 drops rapidly. The temperature of the fixing roller 60 actually falls far below the controlled temperature at the early stage of feeding (undershoot occurs), because, in correlative control, the external heating section 80 is heated after the detected temperature of the fixing roller 60 falls below the controlled temperature. As shown in Table 9, fixing was desirable in the first four sheets; however, fixing defects occurred in the $5^{th}$ to $35^{th}$ printing papers. In the $36^{th}$ and subsequent sheets, it was possible to control the temperature of the fixing roller 60 within the non-offset range, and no fixing defects occurred.

TABLE 9

| | Sheets | | | |
|---|---|---|---|---|
| | Sheets 1-3 | Sheet 4 | Sheets 5-35 | Sheets 36 and up |
| Monochromatic mode | Excellent | Good | Bad | Good |

Figure 8:
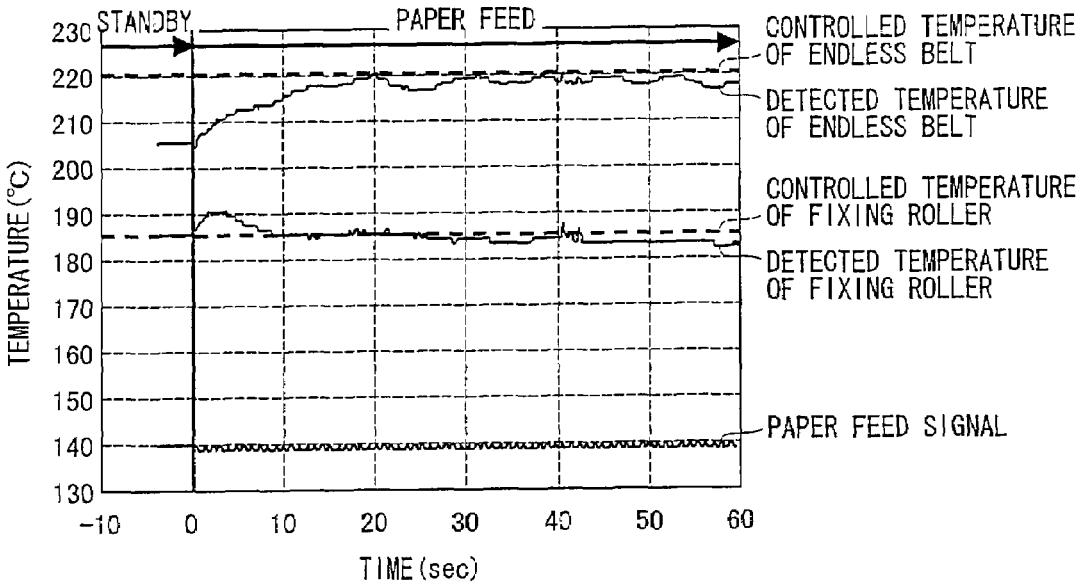
FIG. 8 is a graph representing changes in detected temperature of an endless belt and a fixing roller, when a fixing process in a monochromatic mode was performed under normal control by continuously feeding sheets from standby in the fixing apparatus according to one embodiment of the present invention.

FIG. 8 is a graph representing changes in detected temperature of the endless belt 83 and the fixing roller 60, when printing papers were continuously fed under normal control in the monochromatic mode, starting from the standby state. More specifically, FIG. 8 plots changes in detected temperature of the endless belt 83 and the fixing roller 60 when the control mode was switched to the correlative control after a certain time period has passed since the start of the continuous paper feed from the standby state (after the detected temperature of the fixing roller 60 has risen above the controlled temperature by the heat of the external heating section 80 and then dropped below the controlled temperature by the heat lost to the printing papers).

As shown in FIG. 8, in the continuous paper feed performed under the normal control, the endless belt 83 is heated immediately after the start of the continuous paper feed. As a result, the detected temperature of the fixing roller 60 fluctuated within the non-offset range (at around the controlled temperature of 185° C.), and no fixing defects occurred, as shown in Table 10.

TABLE 10

| | Sheets | | | |
|---|---|---|---|---|
| | Sheet 1 | Sheet 4 | Sheet 5 | Sheets 36 and up |
| Monochromatic mode | Excellent | Excellent | Excellent | Good |

Thus, in the continuous paper feed, it is preferable that the normal control, rather than the correlative control, be performed for the process immediately after the start of feeding. It is more preferable that the normal control be performed for the process immediately after the start of the continuous paper feed, and that the control mode be switched to the correlative control after a certain time period has passed since the start of the continuous paper feed (for example, after the detected temperature of the fixing roller 60 has risen above the controlled temperature by the heat of the external heating section 80 and then dropped below the controlled temperature by the heat lost to the printing papers). This prevents the fixing roller 60 from being overheated even when the paper feed time is long, and thereby accurately controls the fixing roller 60 near the controlled temperature.

Figure 9:
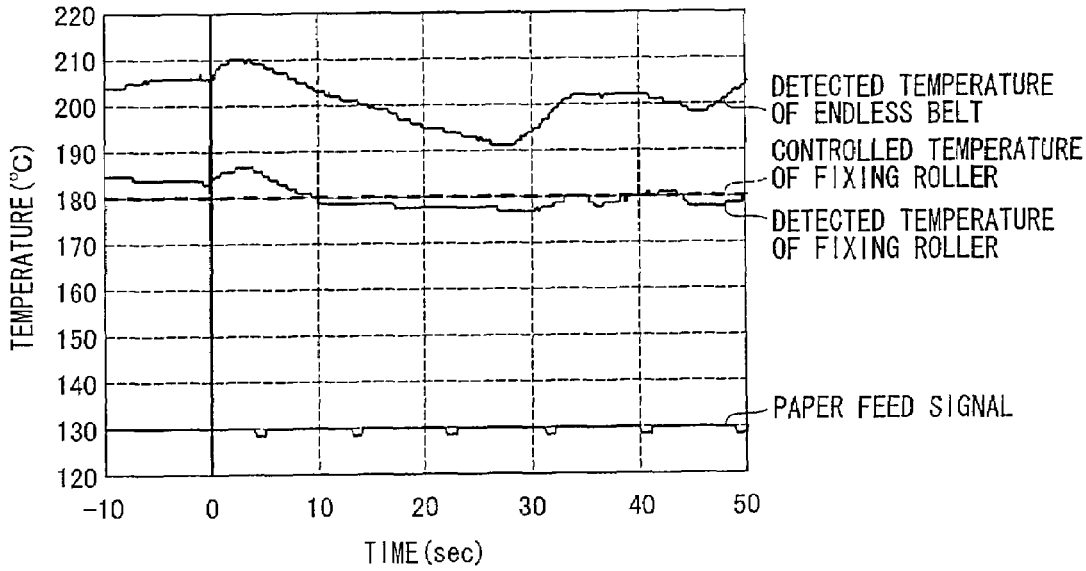
FIG. 9 is a graph representing changes in detected temperature of an endless belt and a fixing roller, when a fixing process in a color mode was performed under correlative control by intermittently feeding sheets from standby in the fixing apparatus according to one embodiment of the present invention.
Figure 10:
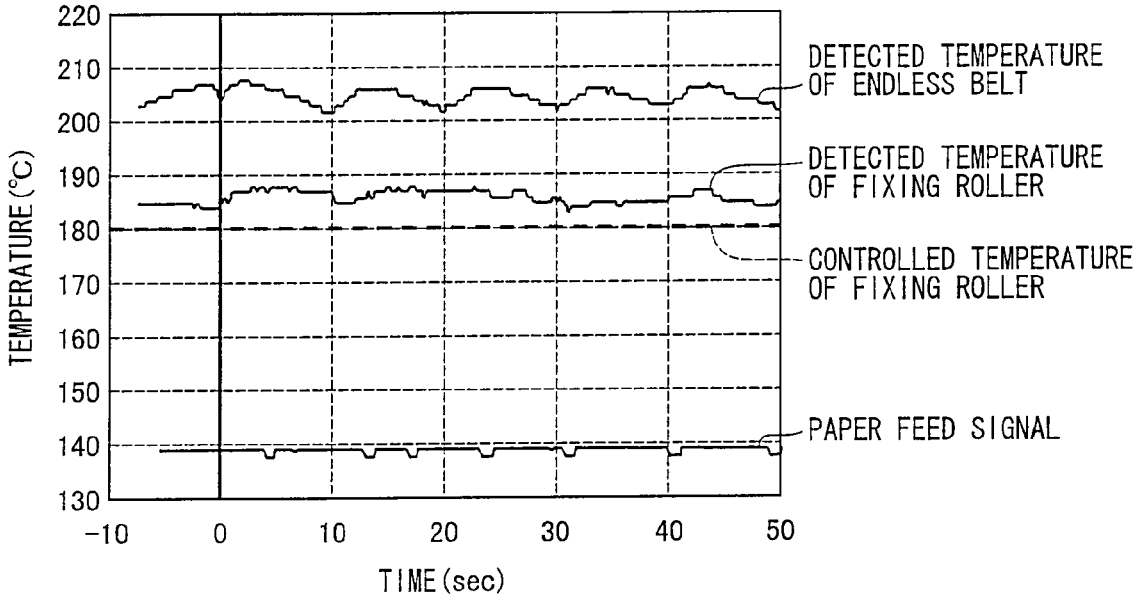
FIG. 10 is a graph representing changes in detected temperature of an endless belt and a fixing roller, when a fixing process in a color mode was performed under normal control by intermittently feeding sheets from standby in the fixing apparatus according to one embodiment of the present invention.

FIG. 9 is a graph representing changes in detected temperature of the endless belt 83 and the fixing roller 60, when printing papers were fed intermittently under correlative control in the color mode, starting from the standby state. FIG. 10 is a graph representing changes in detected temperature of the endless belt 83 and the fixing roller 60, when printing papers were fed intermittently under normal control in the color mode, starting from the standby state.

As shown in FIG. 10, in the normal control, the detected temperatures of the endless belt 83 and the fixing roller 60 fluctuated in the vicinity of the control temperatures (the detected temperature of the fixing roller 60 was above the controlled temperature, but it was within the fixable range), and fixing was desirable.

In the correlative control, as shown in FIG. 9, the detected temperatures of the endless belt 83 and the fixing roller 60 fluctuated within the non-offset range of the color mode, and fixing was desirable. However, in the correlative control, the detected temperature of the endless belt 83 dropped to about 190° C. This is problematic in the following respect. If the feeding in the color mode is finished when the temperature of the endless belt 83 has dropped to about 190° C. and when this is followed by a continuous paper feed in the monochromatic mode, the feeding starts while the endless belt 83 is still cold. Since it takes some time to heat the endless belt 83, the surface temperature of the fixing roller 60 may drop and fixing defect may occur if printing were performed before the endless belt 83 is heated sufficiently. The problem of fixing defect becomes more prominent when the external heating section 80 (support rollers 81, 82, endless belt 83, etc.) has a large heat capacity and requires long time to warm.

Thus, under such conditions, the color mode may employ the normal control even when the number of feeds is small. For example, when feeding only one or a few sheets, the temperature control section 90*a* may select the normal control or correlative control for the temperature control of the external heating section 80, depending on the current mode of operation (or the feeding speed). This can be performed, for example, by selecting the normal control for the color mode, or the correlative control for the monochromatic mode. In this way, optimum temperature control can be performed in the both modes.

However, in the foregoing case, the temperature control in the color mode can be performed more accurately with the correlative control. Further, in the foregoing case, the controlled temperature of the external heating section 80 (endless belt 83) is lower in the color mode than in the monochromatic mode (the controlled temperature of the external heating section 80 is 205° C. in the color mode as opposed to 220° C. in the monochromatic mode). As such, the surface temperature of the fixing roller 60 does not rise excessively even under normal control. In the event where the controlled temperature of the external heating section 80 needs to be increased above 205° C. (for example, when a continuous paper feed in the color mode causes undershoot and generates fixing defects at the control temperature of 205° C. for the external heating section 80), feeding a small number of sheets under normal control in the color mode may increase the detected temperature of the fixing roller 60 above the controlled temperature as in the monochromatic mode. In this case, it is preferable to perform the correlative control, even though the number of sheets is small.

Thus, in the foregoing case, it is preferable that feeding of only one or a few sheets be performed under the correlative control regardless of the color mode or the monochromatic mode, and under the normal control only when sheets are continuously fed in the monochromatic mode, for example.

It should be noted that, for example, when the toner is monochromatic toner that can cover the non-offset range of 170° C. to 210° C., inclusive, in the monochromatic mode, the feeding in the monochromatic mode may be performed under the correlative control, regardless of the number of sheets.

As described above, in the fixing apparatus 40 of the present embodiment, the temperature control section 90*a* controls the respective members in the following manner when feeding only one sheet (single mode), or continuously feeding a small number of sheets below a predetermined number in the monochromatic mode or color mode. Specifically, the correlative control is performed when the controlled temperature of the external heating section 80 in the color mode is not high (for example, when the controlled temperature of the external heating section 80 in the color mode is 205° C. as in the foregoing case), or after a predetermined time has passed since the start of the normal control in the color mode. More specifically, the temperature control section 90*a* controls ON/OFF of the halogen lamp 86 based on the result of comparison between the surface temperature of the endless belt 83, as detected by the thermistor 85, and the controlled temperature of the endless belt 83, and based on the result of comparison between the surface temperature of the fixing roller 60, as detected by the thermistor 65, and the controlled temperature of the fixing roller 60. This enables the temperature of the external heating section 80 (endless belt 83) to be accurately controlled, and the temperature of the endless belt 83 does not fluctuate excessively.

To describe more specifically, in the conventional control method as disclosed in Patent Publication 1, the first detecting means and second detecting means are connected to each other in parallel, and a mean resistance of these two detecting means is used for feedback in the temperature control of the external heating section. As such, the temperature control does not reflect individual results of temperature detection for the fixing member and the external heating section, with the result that the temperatures of these members cannot accurately be controlled at target temperatures. This leads to situations where the temperature of the external heating section falls below the temperature of the fixing member, or excessively increases.

In contrast, in the fixing apparatus 40 of the present embodiment, the temperature control section 90*a* controls ON/OFF of the halogen lamp 86 based on the result of comparison between the surface temperature of the endless belt 83, as detected by the thermistor 85, and the controlled temperature of the endless belt 83, and based on the result of comparison between the surface temperature of the fixing roller 60, as detected by the thermistor 65, and the controlled temperature of the fixing roller 60. This enables the temperature of the external heating section 80 (endless belt 83) to be accurately controlled, and the temperature of the endless belt 83 does not fluctuate excessively.

In the technique disclosed in Patent Publication 1, the problem of temperature drop or excessive heating in the external heating section becomes especially serious when feeding only a single sheet of paper or continuously feeding a small number of papers, or when images are continuously formed in the color mode of a low fixing temperature over extended time periods.

In contrast, in the present embodiment, the halogen lamp 86 is controlled in the following manner when feeding only a single sheet of paper (single mode), or continuously feeding a small number of sheets below a predetermined number in the monochromatic mode and the color mode. Specifically, the halogen lamp 86 is control by correlative control when the controlled temperature of the external heating section is not high, or after a predetermined time has passed since the start of normal control in the color mode. This prevents a temperature drop or excessive temperature rise in the external heating section.

Further, in the present embodiment, the temperature control section 90*a* controls ON/OFF of the halogen lamp 86 under normal control, when continuously feeding papers above a predetermined number in the monochromatic mode, or until a predetermined time elapses since the start of a continuous paper feed in the color mode. Specifically, the halogen lamp 86 is turned on when the surface temperature of the endless belt 83 as detected by the thermistor 85 is below the controlled temperature of the endless belt 83, and is turned off when the surface temperature of the endless belt 83 as detected by the thermistor 85 is above the controlled temperature of the endless belt 83. This prevents the surface temperature of the fixing roller 60 from falling below the non-offset range, and thereby prevents fixing defects.

In the present embodiment, the temperature control section 90*a* has been described to control ON/OFF of the halogen lamp 86. However, the present invention is not limited to such an example. For example, the temperature control section 90*a* may control the heating power supply section 99 to control the amount of power supplied to the halogen lamp 86, so that the calorific value of the halogen lamp 86 can be controlled stepwise or continuously. More specifically, in the correlative control, the temperature control section 90*a* may be adapted to control the calorific value (the amount of heat supplied to the endless belt 83) of the halogen lamp 86 based on the result of comparison between the surface temperature of the endless belt 83, as detected by the thermistor 85, and the controlled temperature of the endless belt 83, and based on the result of comparison between the surface temperature of the fixing roller 60, as detected by the thermistor 65, and the controlled temperature of the fixing roller 60. In the normal control, the temperature control section 90*a* may control the calorific value of the halogen lamp 86 based on the result of comparison between the surface temperature of the endless belt 83, as detected by the thermistor 85, and the controlled temperature of the endless belt 83.

Further, in the image forming apparatus 1, switching of the color mode and the monochromatic mode may be made by the main control section, based on an image read out from a document. In this case, the image forming apparatus 1 is adapted to include a scanner (not shown) for reading image data from a document, and an image processing section (not shown) for processing the image data, wherein image is formed on printing paper P based on the image data processed by the image processing section. In the image processing section, a document type discriminating process is performed that discriminates a document type (color document or monochromatic document) using the image data.

For the discrimination of a color document and a monochromatic document, a method described in Japanese Laid-Open Patent Publication No. 4-282968 can be used, for example. In this method, each pixel is discriminated as either a color pixel or a monochromatic pixel, and when a continuous series of pixels is detected that consists of a predetermined number or greater numbers of color pixels in a given order, this continuous series of color pixels is recognized as a color block. When such color blocks are found in a predetermined number or greater numbers within a single line, the line in which these color blocks reside is counted as a color line. If a document has a predetermined number of color lines, the document is determined as a color image. If not, the document is determined as a monochromatic image. This discrimination of color document and monochromatic document is performed by the image processing section. In the image processing section, analog signals of RGB read out from the document in a color image input apparatus such as a scanner are subjected to predetermined processes, which include: an A/D conversion process, a shading correction process, an inputted tone correction process, a segmentation process, a color correction process, a black generation and undercolor removal process, a spatial filter process, and a tone reproduction process. The result is outputted as digital color signals of CMYK to a color image output apparatus (an engine unit of an electrophotographic or ink jet system). In this case, the image input apparatus, the image processing section, and the image output apparatus make up the image forming apparatus 1, for example.

In the image forming apparatus 1 of the present embodiment, the transport speed is varied between the color mode and the monochromatic mode. More specifically, the transport speed is varied by the switching of the color mode and the monochromatic mode. However, it is not necessarily required to vary the transport speed by switching the color mode and the monochromatic mode.

For example, the image forming apparatus 1 of the present embodiment may be adapted to switch the processing mode according to user instructions, between a fast processing mode in which the image forming process is performed at a transport speed of 350 mm/s, and a slow processing mode in which the image forming process is performed at a transport speed of 170 mm/s. In this case, the control section 90 varies the value of controlled temperature T1 between the fast processing mode and the slow processing mode. The temperature of the endless belt 83 can also be varied in this structure, according to the transport speed of printing paper P during a paper feed.

Further, the image forming apparatus 1 includes a scanner (not shown) for reading image data from a document, and an image processing section (not shown) for processing the image data, wherein an image is formed on printing paper P based on the image data processed by the image processing section. In the image processing section, a document type discriminating process is performed in which the type of document (for example, a text document made up of texts and background, a photographic document, etc.) is identified using the image data.

In the image forming apparatus 1, the transport speed may be varied according to the type of document as identified by the image processing section. In this case, the control section 90 varies the value of controlled temperature T1 according to the type of document. (For example, the transport speed is increased when the image to be formed on a printing paper P is an image from a text document, because images read out from text documents do not deteriorate greatly even when processed at high speed. When forming an image read from a photographic document, a slow transport speed is adapted because photographic images are likely to deteriorate when processed at high speed.)

The document type discriminating process can be performed by known methods, for examples, as described in Japanese Laid-Open Patent Publication No. 2002-232708. However, the document type discriminating process is not just limited to this method. The following briefly describes procedures of the document type discriminating process.

Each pixel of image data read out from a document is treated in turn as a current pixel, and the following processes (1) through (6) are performed in an n×m block containing the current pixel at the center.

(1) Calculation is performed to yield a minimum density value and a maximum density value.

(2) A maximum density difference is calculated from the minimum density value and the maximum density value.

(3) A sum of density complexities, which is the sum of absolute values of density differences between adjacent pixels is calculated.

(4) Comparison is made between the maximum density difference and a threshold value of maximum density difference, and between the sum of density complexities and a threshold value of sum of density complexities. When the maximum density difference is smaller than the threshold value of maximum density difference, and sum of density complexities is smaller than the threshold value of sum of density complexities, the current pixel is determined as a background/photographic pixel. If these conditions are not met, the current pixel is determined as a text/halftone pixel.

(5) For the current pixel determined as a background/photographic pixel, the maximum density difference is compared with a threshold value of the background/photographic pixel. If the maximum density difference is smaller than the threshold value of the background/photographic pixel, the current pixel is determined as a background pixel. If not, the current pixel is determined as a photographic pixel.

(6) For the current pixel determined as a text/halftone pixel, the sum of density complexities is compared with the product of maximum density difference and the threshold value of text/halftone pixel. If the sum of density complexities is smaller than the product of maximum density difference and the threshold value of text/halftone pixel, the current pixel is determined as a text pixel. If not, the current pixel is determined as a halftone pixel.

Then, the number of pixels is counted for the photographic pixels, text pixels, halftone pixels, and background pixels. The type of document is then determined based on these pixel counts. For example, when the pixel count for the text pixels is 30% of the total number of pixels, the document is discriminated as a text document. When the proportion of photographic pixels in the total number of pixels is 10%, the document is discriminated as a photographic document.

Second Embodiment

The following will describe another embodiment of the present invention. For convenience of explanation, constituting members having the same functions as those already described in the First Embodiment are given the same reference numerals and explanations thereof are omitted here.

Figure 11:
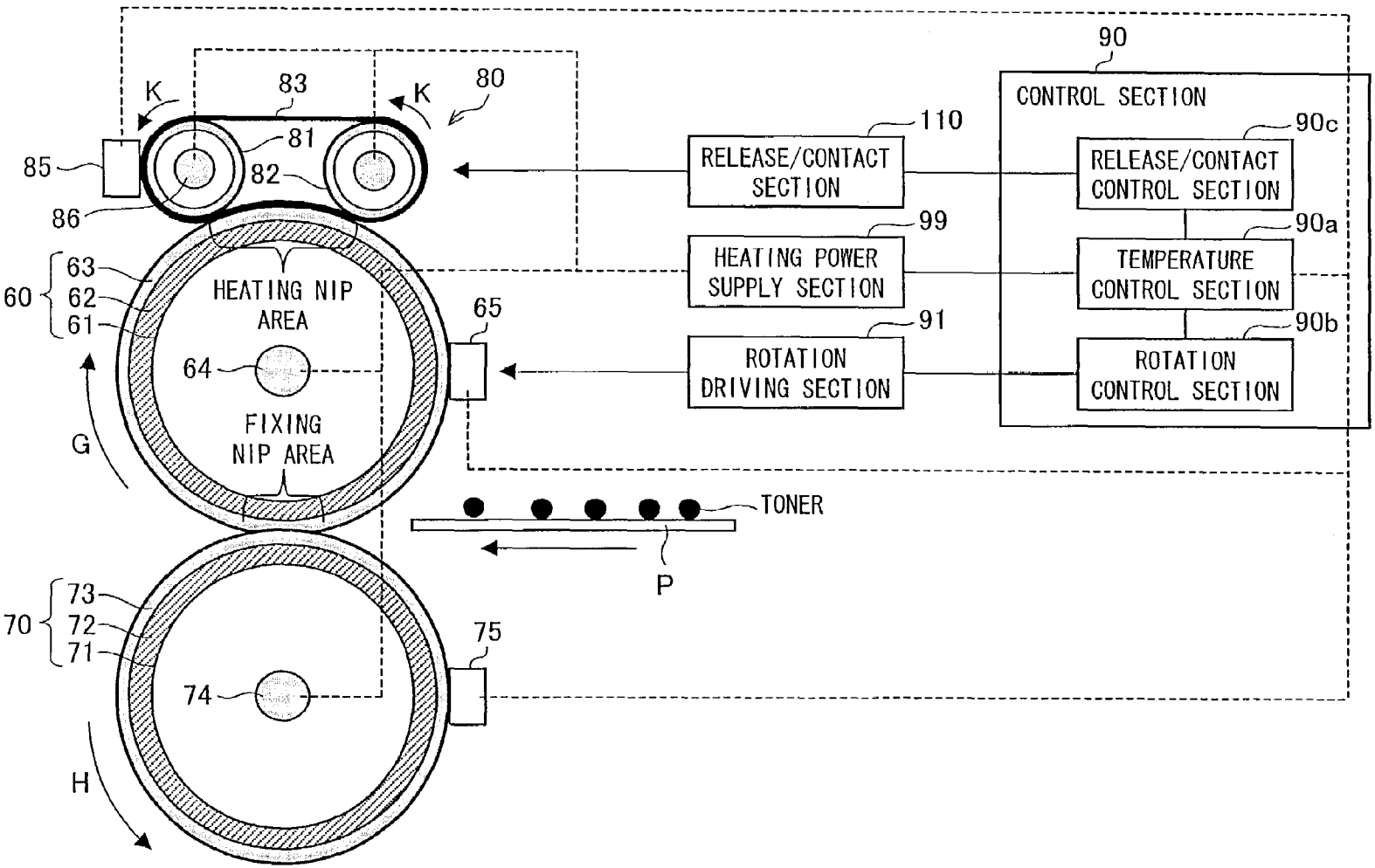
FIG. 11 is an explanatory drawing showing a schematic structure of a fixing apparatus according to another embodiment of the present invention.

FIG. 11 is an explanatory drawing showing a schematic structure of a fixing apparatus 40*a* according to the present embodiment. In the present embodiment, the fixing apparatus 40*a*, instead of the fixing apparatus 40 of the First Embodiment, is provided in the image forming apparatus 1. As shown in FIG. 11, the fixing apparatus 40*a* differs from the fixing apparatus 40 in that it includes a release/contact section 110 for separating the external heating section 80 from the fixing roller 60, and a separation control section 90*c*, provided in the control section 90, for controlling operations of the release/contact section 110.

Figure 12:
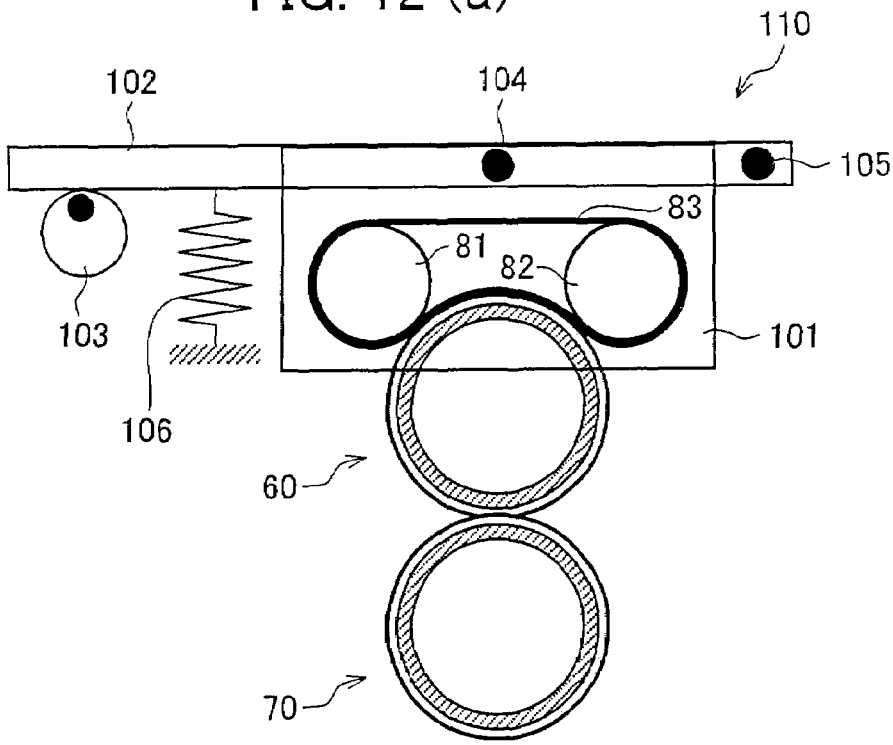
FIG. 12(*a*) is an explanatory drawing illustrating a structure of a release/contact section provided in the fixing apparatus according to another embodiment of the present invention, in which an external heating section is in contact with a fixing roller.
Figure 12:
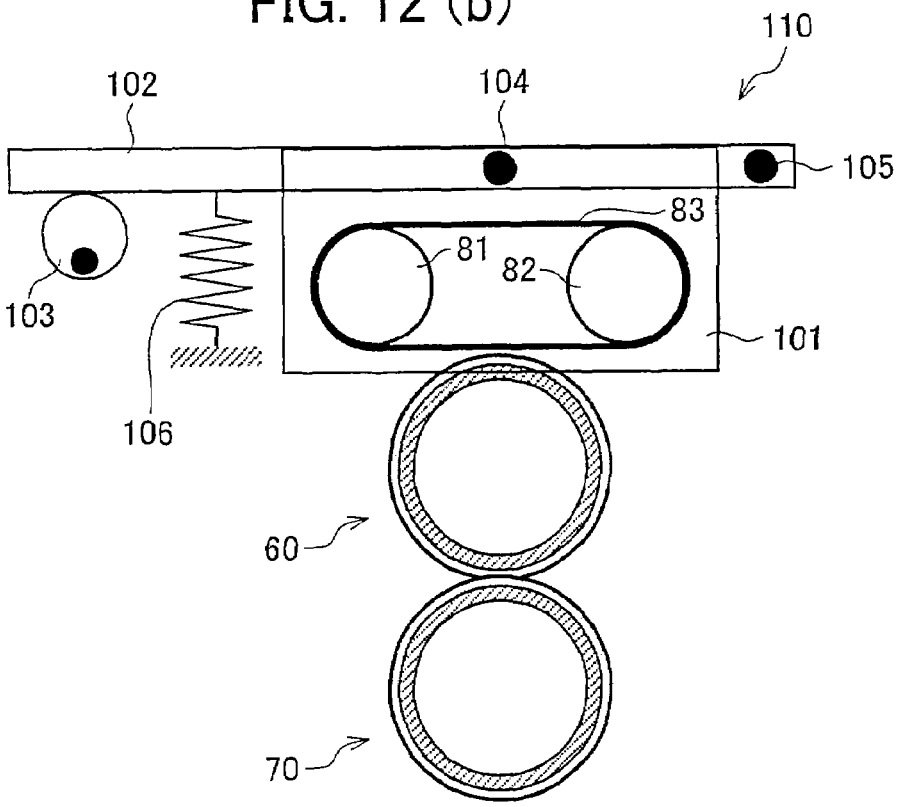

FIG. 12(*a*) and FIG. 12(*b*) are explanatory drawings showing an exemplary structure of the release/contact section 110, respectively illustrating a state in which the external heating section 80 is in contact with the fixing roller 60, and a state in which the external heating section 80 is separated from the fixing roller 60.

As shown in FIG. 12(*a*) and FIG. 12(*b*), the release/contact section 110 includes sideboards 101, an arm 102, an eccentric cam 103, a fulcrum 104, a fulcrum 105, and a spring 106. The sideboards 101 are provided on the both sides of the support rollers 81 and 82 to rotably support the support rollers 81 and 82 via bearings (not shown) or the like. Further, the sideboards 101 are rotably supported on the arm 102 at the fulcrum 104, so that the sideboards 101 can rotate in directions perpendicular to the axial direction of the support rollers 81 and 82.

One end of the arm 102 is rotably supported on a frame (not shown) of the fixing apparatus 40 and at the fulcrum 105, so that the arm 102 is pushed against the spring 106 about the fulcrum 105, in a direction toward the fixing roller 60.

The eccentric cam 103 is provided in contact with the other end of the arm 102. The eccentric cam 103 is driven to rotate by driving means (not shown) such as a motor. Operations of the driving means are controlled by the separation control section 90*c* provided in the control section 90. By controlling the driving means, the separation control section 90*c* rotates the eccentric cam 103 to move the arm 102 away from the fixing roller 60 (FIG. 12(*a*)) or toward the fixing roller 60 (FIG. 12(*b*)). By the movement of the arm 102, the endless belt 83 is pressed against the fixing roller 60 or separated from the fixing roller 60.

Figure 13:
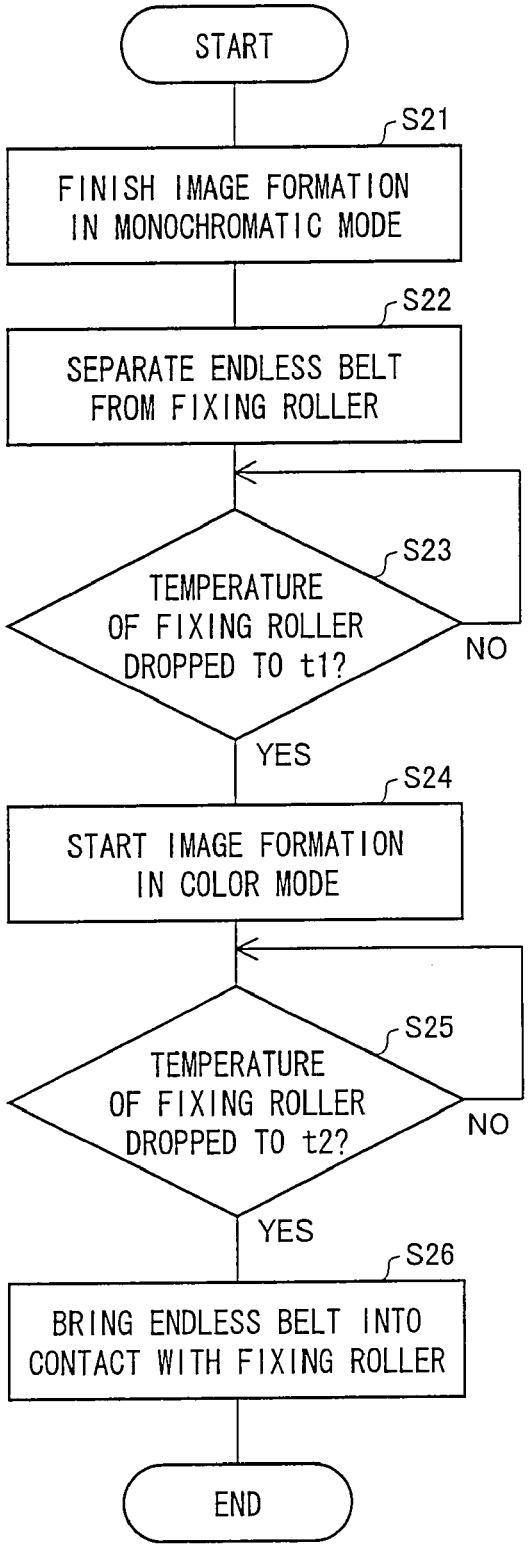
FIG. 13 is a flowchart representing processes of image formation in which the monochromatic mode is followed by the color mode, in the fixing apparatus according to another embodiment of the present invention.

The following will describe operations of the fixing apparatus 40*a* in forming images first in the monochromatic mode and then in the color mode. FIG. 13 is a flow chart showing processes of the control section 90 in successively forming images in the monochromatic mode and then in the color mode.

When image formation in the monochromatic mode is finished (S21), the separation control section 90*c* controls the release/contact section 110 to separate the endless belt 83 from the fixing roller 60 (S22), and causes the fixing roller 60 to rotate by itself. Then, the temperature control section 90*a* determines whether the surface temperature of the fixing roller 60, as detected by the thermistor 65, has dropped to a predetermined temperature t1 (180° C. in this embodiment) (S23). If NO in S23, the fixing roller 60 is kept rotated without the endless roller 83, and the temperature control section 90*a* keeps monitoring the surface temperature of the endless belt until it drops to the predetermined temperature t1.

If it is determined in S23 that the surface temperature of the fixing roller 60 has dropped to t1, the temperature control section 90*a* signals the main control section of the image forming apparatus 1 to start image forming operations in the color mode (S24).

Next, the temperature control section 90*a* determines whether the surface temperature of the fixing roller 60, as detected by the thermistor 65, has dropped to a predetermined temperature t2 (172° C. in this embodiment) (S25). If NO in S25, the image forming operation is continued with the endless belt 83 separated from the fixing roller 60, and the temperature control section 90*a* keeps monitoring the surface temperature of the fixing roller 60 until it drops to t2.

If it is determined in S25 that the surface temperature of the fixing roller 60 has dropped to t2 (172° C.) in this embodiment), the temperature control section 90*a* informs the separation control section 90*c* as such. In response, the separation control section 90*c* controls the release/contact section 110 to bring the endless belt 83 into contact with the fixing roller 60 (S26), and the image forming operation is continued with the endless belt 83 in contact with the fixing roller 60.

In this manner, in the fixing apparatus 40*a*, when image formation in the monochromatic mode is followed by image formation in the color mode, the endless belt 83 is separated from the fixing roller 60 until the surface temperature of the fixing roller 60 after the image formation in the monochromatic mode reaches the predetermined temperature t2.

In the image forming apparatus 1, the processing speed (processing speed, copying speed) is different in the monochromatic mode and the color mode. This is problematic when printing papers containing both color and monochromatic documents (when performing image formation processes in the monochromatic mode and the color mode), because the temperature range (common non-offset range) that allows for fixing both in the monochromatic mode (processing speed of 350 mm/s) and the color mode (processing speed of 175 mm/s) is very narrow (180° C. to 190°, inclusive, in this embodiment).

Thus, when the controlled temperature of the fixing roller 60 in the monochromatic mode (processing speed of 350 mm/s) is 185° C. as in the present embodiment, the endless belt 83 cannot be kept in contact with the fixing roller 60 when images are to be formed in the color mode (processing speed of 170 mm/s) immediately after the image formation in the monochromatic mode, because doing so increases the surface temperature of the fixing roller 60.

As a countermeasure, in the present embodiment, the endless belt 83 is separated from the fixing roller 60 until the temperature of the fixing roller 60 after the image formation in the monochromatic mode reaches the predetermined temperature t2. This prevents the surface temperature of the fixing roller 60 from increasing excessively.

The predetermined temperature t1 is set such that it allows the image formation in the color mode to be performed without causing high-temperature offset. The predetermined temperature t2 is appropriately set such that the endless belt 83 brought into contact with the fixing roller 60 after detection of the predetermined temperature t2 prevents the surface temperature of the fixing roller 60 from falling below the non-offset range of the color mode. That is, the predetermined temperature t2 is appropriately set taking into account, for example, the time required for the endless belt 83, since the start of driving of the eccentric cam 103, to be brought into contact with the fixing roller 60 with a predetermined pressure, and the time required for the surface temperature of the fixing roller 60 to start rising after the endless belt 83 has been brought into contact with the fixing roller 60.

It is preferable that the temperature t1 and t2 be set to satisfy t1≧t2. If t1<t2, the endless belt 83 is brought into contact with the fixing roller 60 before the printing paper is fed to the fixing roller 60. In this case, the surface temperature of the fixing roller 60 rises instantaneously by the contact with the endless belt 83, with the result that high-temperature offset may occur in the subsequent image formation in the color mode.

By setting t1≧t2, feeding of a printing paper is started and image formation in the color mode is performed when the surface temperature of the fixing roller 60 has dropped to t1. Meanwhile, by setting t1≧t2, the endless belt 83 is brought into contact with the fixing roller 60 when the temperature of the fixing roller 60 has dropped to t2, lower than t1, by the feeding of printing papers. In this way, the surface temperature of the fixing roller 60 can be prevented from increasing excessively due to the contact with the endless belt 83. As a result, high-temperature offset can be prevented.

In the foregoing description of the present invention, when image formation in the monochromatic mode is immediately followed by image formation in the color mode, the endless belt 83 is separated from the fixing roller 60 after the image formation in the monochromatic mode has been finished. However, the present invention is not limited to such an example. For example, the endless belt 83 may be separated from the fixing apparatus 60 after images have been formed in an image forming mode with a fast processing speed or a high fixing temperature, or in an image forming mode with short paper feed intervals, whenever there is a possibility that the surface of the fixing roller 60 is overheated. Such cases include when image formation in an image forming mode with a fast processing mode is immediately followed by image formation in an image forming mode with a slow processing speed; when image formation in an image forming mode with a high fixing temperature is immediately followed by image formation in an image forming mode with a low fixing temperature; and when image formation in an image forming mode with short paper feed (time) intervals is immediately followed by image formation in an image forming mode with long paper feed intervals.

Further, in the fixing apparatus 40*a*, the endless belt 83 is brought into contact with the fixing roller 60 when the surface temperature of the fixing roller 60, separated from the endless belt 83, has dropped to the predetermined temperature t1. That is, after the endless belt 83 has been separated from the fixing roller 60, the fixing roller 60 is caused to rotate by itself, without having the endless belt 83 in contact therewith, until the surface temperature of the fixing roller 60 drops to the predetermined temperature t1. In this way, the surface temperature of the fixing roller 60 can be lowered quickly.

EXAMPLE 2

With the fixing apparatus 40*a*, experiment was conducted to examine how changes in temperature of the fixing roller 60 influence fixability when prints were continuously made from documents containing both color and monochromatic images. The processing speed and copying speed for the color mode and the monochromatic mode were set as shown in Table 2. The controlled temperatures of the fixing roller 60 and the endless belt 83 were set as shown in Table 3. The temperature control method of the external heating section 80 was set as shown in Table 4.

Figure 14:
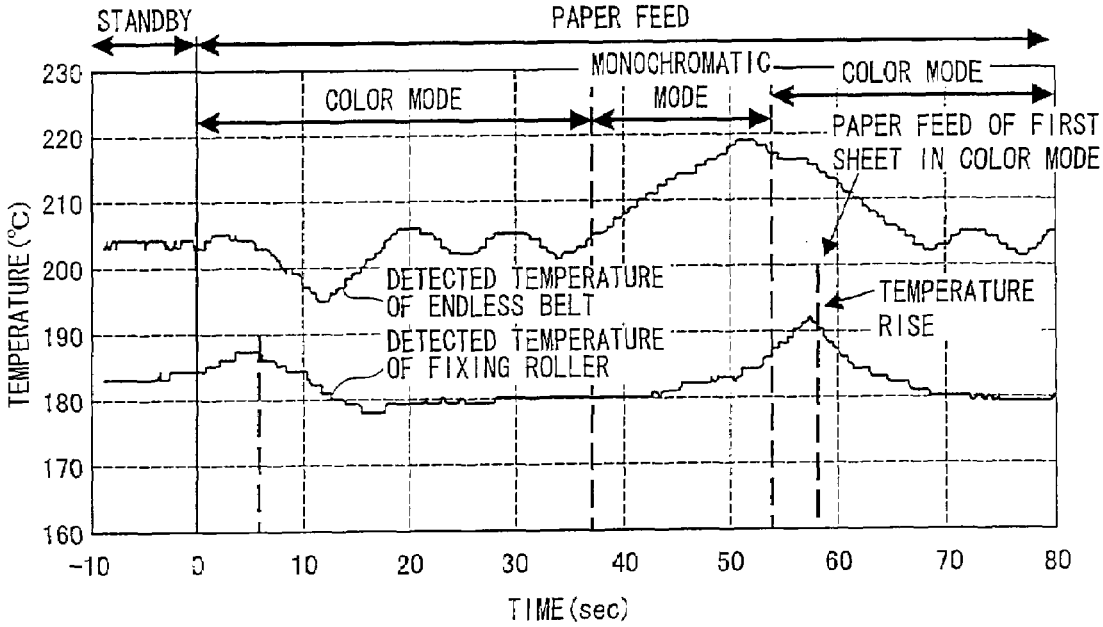
FIG. 14 is a graph representing changes in temperature of the endless belt and the fixing roller, when a fixing process in the color mode was performed without separating the endless belt from the fixing roller and immediately after a fixing process for a plurality of sheets in the monochromatic mode has been finished.

FIG. 14 is a graph representing changes in surface temperature of the endless belt 83 and the fixing roller 60, when images were formed first in the color mode for the $1^{st}$ through $18^{th}$ printing papers, then in the monochromatic mode for the $19^{th}$ through $38^{th}$ printing papers, and again in the color mode for the $39^{th}$ through 53 printing papers, without separating the endless belt 83 from the fixing roller 60.

As can be seen in FIG. 14, in the transition from the monochromatic mode to the color mode, the processing speed slows and the paper feed interval increases. That is, it takes about 4 seconds for the first printing paper ($39^{th}$ printing paper) in the color mode to pass through the fixing roller 60 after the last printing paper ($38^{th}$ printing paper) in the monochromatic mode has passed through the fixing roller 60. As such, if the endless belt 83 is not separated from the fixing roller 60 as in this case, the surface temperature of the fixing roller 60 increases to 192° C. in these 4 seconds. This causes high-temperature offset in the printing paper ($39^{th}$ printing paper) that is processed first in the color mode immediately after the monochromatic mode.

Figure 15:
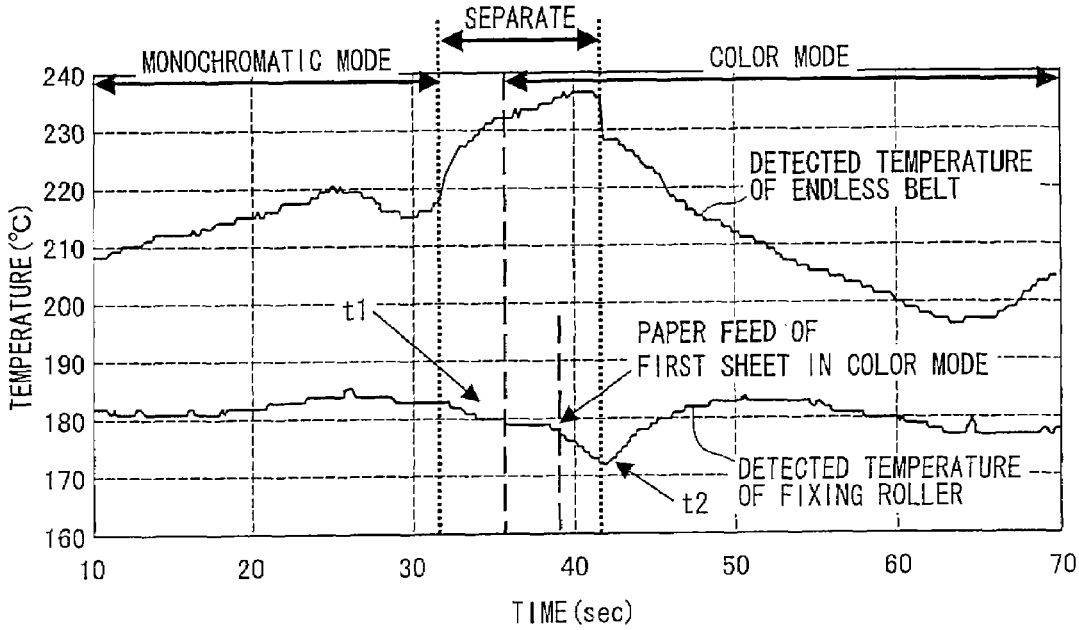
FIG. 15 is a graph representing changes in surface temperature of the endless belt and the fixing roller, when image formation was performed in the following sequences using the fixing apparatus according to another embodiment of the present invention: After a fixing process for a plurality of sheets has been continuously performed in the monochromatic mode, the endless belt was separated from the fixing roller and the fixing roller was rotated itself. This was followed by image formation in the color mode, which was started when the surface temperature of the fixing roller has dropped to a predetermined temperature t1. When the surface temperature of the fixing roller has dropped to a predetermined temperature t2, the endless belt was brought into contact with the fixing roller and the image formation in the color mode was continued in the color mode.

FIG. 15 is a graph representing changes in surface temperature of the endless belt 83 and the fixing roller when images were formed in the following sequence. First, images were formed in the monochromatic mode for the $1^{st}$ through $35^{th}$ printing papers, and the endless belt 83 was separated from the fixing roller 60 and the fixing roller 60 was caused to rotate by itself. Then, image formation in the color mode was started when the surface temperature of the fixing roller 60 dropped to the predetermined temperature t1 (180° C.), and images were formed in the color mode for the $36^{th}$ through $50^{th}$ printing papers, with the endless belt 83 brought in contact with the fixing roller 60, when the surface temperature of the fixing roller 60 dropped to the predetermined temperature t2 (172° C.).

As shown in FIG. 15, the first printing paper ($36^{th}$ printing paper) in the color mode is fed at t1 (180° C.), and the surface temperature of the fixing roller 60 drops as the sheets are continuously fed. The endless belt 83 is brought into contact with the fixing roller 60 when the surface temperature of the fixing roller 60 reaches t2 (172° C.). This increases the surface temperature of the fixing roller 60. However, overheating does not occur, and the surface temperature of the fixing roller 60 fluctuates below 185° C.

More specifically, as shown in FIG. 15, the endless belt 83 is separated from the fixing roller 60 and the fixing roller 60 is caused to rotate by itself at the transition from the monochromatic mode to the color mode. By feeding a paper when the temperature of the fixing roller 60 has dropped to t1, high-temperature offset is prevented. Further, the endless belt 83 is brought into contact with the fixing roller 60 when the surface temperature of the fixing roller 60 has dropped to t2. This increases the temperature of the fixing roller 60, so that the surface temperature of the fixing roller 60 can be maintained within the non-offset range.

Note that, the foregoing embodiments have been described through the case where the control device 90 is realized by a control integrated circuit board. However, the present invention is not just limited to such an example. The functions of the respective control members provided in the control section 90 may alternatively be realized by software, using a processor such as a CPU. In this case, the control section 90 is realized by, for example, a CPU (central processing unit) for executing commands for the control programs that realize the respective functions, a ROM (read only memory) in which the programs are stored, a RAM (random access memory) that develop the programs, and a storage device (storage medium), such as memory, in which the programs and various data are stored. The objects of the present invention can be achieved with a computer-readable storage medium in which program code (executable program, intermediate code program, source program) for the control programs, i.e., software for realizing the functions of the control section 90, is stored, and by supplying the storage medium to the control section 90 and reading and executing the program code by a computer (or CPU, MPU).

For example, such storage media may be tapes such as magnetic tapes and cassette tapes; disks such as magnetic disks like floppy disk® and hard disk, and optical disks such as CD-ROM, MO, MD, DVD, and CD-R; cards such as IC cards (including memory cards) and optical cards; or semiconductor memories such as mask ROM, EPROM, EEROM, and flash ROM.

Further, the control section may be arranged so as to be connectable to a communications network, and the program code may be supplied to the control section through the communications network. Examples of the communication network include, but are not particularly limited to, the Internet, intranet, extranet, LAN, ISDN, VAN, CATV communications network, virtual private network, telephone network, mobile communications network, and satellite communications network. Further, a transmission medium that constitutes the communications network is not particularly limited. The transmission medium may be, for example, wired lines such as IEEE 1394, USB, power-line carrier, cable TV lines, telephone lines, or ADSL lines; or wireless connections such as IrDA and a remote control using infrared light, Bluetooth®, 802.11, HDR, mobile phone network, satellite connections, and terrestrial digital network. Note that the present invention can also be realized in the form of a computer data signal (series of data signals) embedded in a carrier wave, as embodied by electronic transmission of the program code.

The foregoing description of the embodiments has been given through the case where the fixing member (fixing roller 60) and the pressing member (pressing roller 70) are rollers. However, the present invention is not limited to such an example. For example, these members may be realized by belts.

Further, the foregoing description of the embodiments has been given through the case where the halogen lamp is installed inside the fixing roller 60 and the pressing roller 70. However, the present invention is not just limited to such an example. For example, the halogen lamp may not be provided for the pressing roller 70.

As described above, a fixing apparatus according to the present invention includes: a fixing member; a pressing member; and an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, the fixing apparatus including: a first temperature-detecting device for detecting a surface temperature of the external heating member; a second temperature-detecting device for detecting a surface temperature of the fixing member; and a control section for performing first control by which a heating operation of the first heating device is controlled based on a first comparison result, which is a result of comparison between a temperature detected by the first temperature-detecting device and a controlled target temperature of the external heating member, and a second comparison result, which is a result of comparison between a temperature detected by the second temperature-detecting device and a controlled target temperature of the fixing member.

In the case where the surface temperature of the external heating member as detected by the first temperature-detecting device has not reached the controlled target temperature of the external heating member, heating the external heating member may cause the temperature of the fixing member to increase above the controlled target temperature, depending on the current surface temperature of the fixing member. Thus, the fixing member may be overheated and high-temperature offset and other defects may occur when the heating operation of the external heating member by the first heating device is controlled based on the surface temperature of the external heating member, as detected by the first temperature-detecting device, and the controlled target temperature of the external heating member.

In the foregoing arrangement of the present invention, the control section controls the heating operation of the first heating device based on (i) the first comparison result, which is the result of comparison between the temperature detected by the first temperature-detecting device and the pre-set controlled target temperature of the external heating member, and (ii) the second comparison result, which is the result of comparison between the temperature detected by the second temperature-detecting device and the pre-set controlled target temperature of the fixing member. In this way, the temperature of the external heating member can be appropriately controlled within the temperature range that allow for a fixing process without causing fixing defects.

The fixing apparatus may be adapted so that the first control controls the heating operation of the first heating device by increasing a temperature of the external heating member, when the temperature detected by the first temperature-detecting device is lower than the controlled target temperature of the external heating member and when the temperature detected by the second temperature-detecting device is lower than the controlled target temperature of the fixing member, and that the first control controls the heating operation of the first heating device by not increasing a temperature of the external heating member, when the temperature detected by the first temperature-detecting device is equal to or greater than the controlled target temperature of the external heating member and/or when the temperature detected by the second temperature-detecting device is equal to or greater than the controlled target temperature of the fixing member.

According to this arrangement, the first control controls the heating operation of the first heating device by increasing a temperature of the external heating member, when the temperature detected by the first temperature-detecting device is lower than the controlled target temperature of the external heating member and when the temperature detected by the second temperature-detecting device is lower than the controlled target temperature of the fixing member, and the first control controls the heating operation of the first heating device by not increasing a temperature of the external heating member, when the temperature detected by the first temperature-detecting device is equal to or greater than the controlled target temperature of the external heating member and/or when the temperature detected by the second temperature-detecting device is equal to or greater than the controlled target temperature of the fixing member. Thus, the external heating member is not heated when the temperature of the external heating member has not reached the controlled target temperature and when the temperature of the fixing member has reached the controlled target temperature. This prevents the fixing member from being overheated, thereby preventing high-temperature offset.

The fixing apparatus may be adapted so that the control section controls the heating operation of the first heating device based on the first comparison result, the second comparison result, and an amount of heat that is lost per unit time from the fixing member to the printing medium.

The amount of heat lost per unit time from the fixing member to the printing paper is large when there are large numbers of printing papers (continuous feeds) to be subjected to the fixing process, or when the time interval of feeding the printing paper to the nip area between the fixing member and the pressing member is short (the time interval of transporting the printing papers (inter-paper feed period), which becomes shorter as the processing speed and the number of feeds per unit time increase). Thus, the surface temperature of the fixing member can be appropriately controlled when the control section controls the heating operation of the first heating device based on the first comparison result, the second comparison result, and the amount of heat that is lost per unit time from the fixing member to the printing paper.

More specifically, for example, the control section controls the heating operation of the first heating device based on the first comparison result, the second comparison result, and a number of printing media subjected to a fixing process, and/or a time interval of feeding the printing media to a nip area between the fixing member and the pressing member. That is, when the number of continuous feeds is large or when the time interval of feeding the printing paper is short, the surface temperature of the fixing member most likely decreases. This is counteracted by increasing the amount of heat that is supplied from the first heating device to the external heating member (or by turning on the control operation of the external heating member performed by the first heating device), so that the surface of the fixing member can be maintained at a predetermined temperature. On the contrary, when the number of continuous feeds is small or when the time interval of feeding the printing paper is short, the amount of heat supplied from the first heating device to the external heating member is decreased (or the heating operation of the external heating member performed by the first heating device is turned off), so that the surface temperature of the fixing member does not overly increase. In this way, the surface temperature of the fixing member can be appropriately controlled.

Further, the control section may control the heating operation of the first heating device based on the first comparison result, the second comparison result, and a speed at which the printing medium passes through the nip area between the fixing member and the pressing member (the time it takes for the printing medium to pass through the nip (nip area); a value dependent on the processing speed). For example, the fixing apparatus may be adapted so that it is used for an image forming apparatus that is operative to form images in a monochromatic mode using an achromatic color material, and a color mode using a chromatic color material, the image forming apparatus adopting a different image forming speed for the monochromatic mode and the color mode, wherein the control section controls the heating operation of the first heating device based on the first comparison result, the second comparison result, and a current image formation mode selected from the monochromatic mode and the color mode.

When the printing paper passes the nip area between the fixing member and the pressing member at different speeds (processing speeds), the fixing member has only a narrow temperature range (common-non-offset range) that allows for a fixing process without causing fixing defects at any processing speed (the fixing defects being insufficient fixing due to overly low surface temperature of the fixing member, or high-temperature offset due to overly high surface temperature of the fixing member). Thus, if the heating operation of the external heating member by the first heating device is performed based solely on the result of comparison between the detected temperature and the controlled target temperature of the external heating member, it may not be possible to maintain the surface temperature of the fixing member within the common non-offset range. For example, there are cases where the surface temperature of the external heating member has not reached the controlled target temperature of the external heating member, yet the surface temperature of the fixing member has reached the controlled target temperature of the fixing member. In this case, supplying heat from the first heating device to the external heating member may overly increase the surface temperature of the fixing member above the controlled target temperature. There are also cases where, for example, the surface temperature of the fixing member has reached the controlled target temperature and a large amount of heat is transferred from the fixing member to the printing paper. In this case, a heat supply from the first heating device to the external heating member is necessary because the surface temperature of the fixing member otherwise drops and this may cause fixing defects.

The surface temperature of the fixing member can be appropriately controlled when the control section is adapted to control the heating operation of the first heating device based on the first comparison result, the second comparison result, and the speed at which the printing paper passes the nip area between the fixing member and the pressing member.

The fixing apparatus may be adapted to be operative to perform in a plurality of image formation modes with different controlled target temperatures for the fixing member, wherein the control section controls the heating operation of the first heating device based on the first comparison result, the second comparison result, and a current image formation mode. For example, the fixing apparatus may be adapted to be used for an image forming apparatus that is operative to form images in a monochromatic mode using an achromatic color material, and a color mode using a chromatic color material, the image forming apparatus using color materials whose fixing temperature ranges are different between the monochromatic mode and the color mode, wherein the control section controls the heating operation of the first heating device based on the first comparison result, the second comparison result, and a current image formation mode selected from the monochromatic mode and the color mode.

When the controlled target temperature of the fixing member is to cover more than one image formation mode, the fixing member has only a narrow temperature range (common-non-offset range) that allows for a fixing process without causing fixing defects at any processing speed (the fixing defects being insufficient fixing due to overly low surface temperature of the fixing member, or high-temperature offset due to overly high surface temperature of the fixing member). Thus, if the heating operation of the external heating member by the first heating device is performed based solely on the result of comparison between the detected temperature and the controlled target temperature of the external heating member, it may not be possible to maintain the surface temperature of the fixing member within the common non-offset range. For example, there are cases where the surface temperature of the external heating member has not reached the controlled target temperature of the external heating member, yet the surface temperature of the fixing member has reached the controlled target temperature of the fixing member. In this case, supplying heat from the first heating device to the external heating member may overly increase the surface temperature of the fixing member above the controlled target temperature. There are also cases where, for example, the surface temperature of the fixing member has reached the controlled target temperature and a large amount of heat is transferred from the fixing member to the printing paper. In this case, a heat supply from the first heating device to the external heating member is necessary because the surface temperature of the fixing member otherwise drops and this may cause fixing defects.

The surface temperature of the fixing member can be appropriately controlled when the control section is adapted to control the heating operation of the first heating device based on the first comparison result, the second comparison result, and the current image formation mode.

Further, the fixing apparatus may be adopted so that the control section controls the heating operation of the first heating device by switching the first control, and second control in which the heating operation of the first heating device is controlled based on the first comparison result.

For example, when the amount of heat lost per unit time from the fixing member to the printing paper is large, or when the printing paper passes the nip area between the fixing member and the pressing member at different speeds (processing speeds), or when images are formed in one of the image formation modes in which different controlled target temperatures are set for the fixing member, the fixing member has only a narrow temperature range (common non-offset range) that allows for a fixing process without causing fixing defects (insufficient fixing due to overly low surface temperature of the fixing member, or high-temperature offset due to overly high surface temperature of the fixing member). Thus, if the heating operation of the external heating member by the first heating device is performed based solely on the result of comparison between the detected temperature and the controlled target temperature of the external heating member, it may not be possible to maintain the surface temperature of the fixing member within the common non-offset range. For example, there are cases where the surface temperature of the external heating member has not reached the controlled target temperature of the external heating member, yet the surface temperature of the fixing member has reached the controlled target temperature of the fixing member. In this case, supplying heat from the first heating device to the external heating member may overly increase the surface temperature of the fixing member above the controlled target temperature, with the result that high-temperature offset occurs. Further, for example, with the surface temperature of the fixing member at the controlled target temperature, supplying heat from the first heating device to the external heating member causes a problem when a large amount of heat is transferred from the fixing member to the printing paper, the processing speed is slow, or the controlled target temperature of the fixing member is high. Specifically, in this case, the heating operation of the first heating device raises the temperature of the external heating member with a delay, and this causes undershoot in the surface temperature of the fixing member. The insufficient surface temperature of the fixing member may lead to fixing defects.

According to the foregoing arrangement, the control section controls the heating operation of the first heating device by switching the first control, and second control in which the heating operation of the first heating device is controlled based on the first comparison result. This allow the surface temperature of the fixing member to be controlled more appropriately, for example, by controlling the heating operation of the first heating device under the first control in situations where high-temperature offset is likely to occur, or by controlling the heating operation of the first heating device under the second control in situations where undershoot is likely to occur in the surface temperature of the fixing member.

The fixing apparatus may be adapted so that the second control controls the heating operation of the first heating device by increasing a temperature of the external heating member, when the temperature detected by the first temperature-detecting device is lower than the controlled target temperature of the external heating member, and that the second control controls the heating operation of the first heating device by not increasing a temperature of the external heating member, when the temperature detected by the first temperature-detecting device is equal to or greater than the controlled target temperature of the external heating member.

According to this arrangement, the temperature of the external heating member is increased when the temperature detected by the first temperature-detecting device is lower than the controlled target temperature. This enables the external heating member to be quickly heated even when a large amount of heat is transferred from the fixing member to the printing paper, the processing speed is slow, or the controlled target temperature of the fixing member is high. As a result, undershoot does not occur in the surface temperature of the fixing member, and fixing defects are prevented.

The fixing apparatus may be adapted so that the fixing member is a cylindrical member whose longitudinal direction extends perpendicularly to a direction of transport of the printing medium, and that the second temperature-detecting device detects a surface temperature of the fixing member (i) at a middle portion in the longitudinal direction of the fixing member, (ii) at an end portion in the longitudinal direction of the fixing member, or (iii) at the middle portion and the end portion in the longitudinal direction of the fixing member. As used herein, the "middle portion in the longitudinal direction of the fixing member" refers to a portion that falls inside the paper feed region (area of contact between the fixing member and the printing paper) regardless of the paper size. Further, the "end portion in the longitudinal direction of the fixing member" refers to a portion that falls outside of the paper feed region for printing paper of a predetermined size, with respect to the longitudinal direction. For example, when only one heating section is provided in the fixing member, the predetermined size is the maximum fixable size of printing paper used in the fixing apparatus. In this way, the surface of the fixing member in the paper feed region will not be damaged when it is brought into contact with the second temperature-detecting device, even when the second temperature-detecting device is of a contact type such as a contact thermistor. The fixing member may be provided therein a heating section A that primarily heats a middle portion of the fixing member, and a heating section B that primarily heats a region outside of the area in the longitudinal direction of the fixing member heated by the heating section A. In the case where both the heating section A and the heating section B are used to heat the fixing member as in feeding of wide sheets such as A4 or B5 size paper, or only the heating section A is used to heat the fixing member as in feeding of narrow sheets such as a letter, the predetermined size may be the size of a region heated by the heating section A. In other words, the predetermined size may be set so that the end portion in the longitudinal direction is the heated region by the heating section B. In this case, the temperature control by the heating sections A and B can be appropriately performed, for example, by providing the second temperature-detecting device both at the middle portion and the end portion in the longitudinal direction of the fixing member.

The control section can be easily controlled with the arrangement in which the temperature at the middle portion in the longitudinal direction is detected by the second temperature-detecting device and the temperature control of the external heating member is performed based on the result of temperature detection. Further, with the arrangement in which the temperature at an end portion in the longitudinal direction is detected by the second temperature-detecting device and the temperature control of the external heating member is performed based on the result of temperature detection, the temperatures at the both ends of the fixing member can be prevented from increasing, for example, even when the fixing process is performed on a small size sheet (printing paper with short sides). Further, with the arrangement in which the middle portion and end portion in the longitudinal direction are detected by the second temperature-detecting device and the temperature control of the external heating member is performed based on the result of temperature detection, the temperature control in the longitudinal direction (axial direction) of the fixing member can be performed more appropriately.

The fixing apparatus may be adapted so that the external heating section includes a belt suspended by a plurality of support rollers, and heats the fixing member by heating the belt with the first heating device and bringing the belt into contact with the periphery of the fixing member.

According to this arrangement, the belt as the external heating member is brought into contact with the periphery of the fixing member. This increases the nip area between the external heating member and the fixing member, thereby efficiently heating the surface of the fixing member. Further, the amount of heat supplied to the fixing member can be varied both easily and quickly.

The fixing apparatus may be adapted to include a release/contact section for separating the external heating member from the fixing member, wherein, when a first image formation mode and a second image formation mode are successively performed with a controlled target temperature for the fixing member lower in the second image formation mode than in the first image formation mode, the control section separates the external heating member from the fixing member after a fixing operation in the first image formation mode is finished and until the surface temperature of the fixing member as detected by the second temperature-detecting device reaches a predetermines temperature t2. Note that, the predetermined temperature t2 is appropriately set so that, when the external heating member is brought into contact with the fixing member upon detection of t2 in the surface temperature of the fixing member, the surface temperature of the fixing member is maintained in a temperature range that does not cause fixing defects.

According to the foregoing arrangement, when a first image formation mode and a second image formation mode are successively performed with a controlled target temperature for the fixing member lower in the second image formation mode than in the first image formation mode, the control section separates the external heating member from the fixing member after a fixing operation in the first image formation mode is finished and until the surface temperature of the fixing member as detected by the second temperature-detecting device reaches a predetermines temperature t2. This enables the surface temperature of the fixing member to quickly decrease to the controlled target temperature in the second image formation mode.

Further, the fixing apparatus may be adapted to include a driving section for driving the fixing member to rotate, wherein the control section causes the driving section to rotate the fixing member after the fixing operation in the first image formation mode is finished and until the surface temperature of the fixing member as detected by the second temperature-detecting device reaches a predetermined temperature t1, and wherein, for a fixing operation in the second image formation mode, the control section feeds a printing medium to a nip area between the fixing member and the pressing member, after the surface temperature of the fixing member has reached the predetermined temperature t1. The predetermined temperature t1 is appropriately set so that the fixing process in the second image formation mode can be performed without high-temperature offset.

According to this arrangement, the fixing member is caused to rotate by itself after the fixing process in the first image formation mode has been finished and the external heating member has been separated from the fixing member, and until the surface temperature of the fixing member reaches t1. In this way, the surface temperature of the fixing member can approach the controlled target temperature more quickly.

The fixing apparatus may be adapted so that the predetermined temperature t1 and the predetermined temperature t2 are related to each other by $t1 \geqq t2$.

When $t1 < t2$, the external heating member is brought into contact with the fixing member before the printing paper is fed to the nip area between the fixing member and the pressing member. In this case, the surface temperature of the fixing member rises instantaneously by the contact with the external heating member, with the result that high-temperature offset may occur when the fixing process in the second image formation mode is started. By setting $t1 \geqq t2$, feeding of a printing paper is started and the fixing process in the second image formation mode is performed when the surface temperature of the fixing member has become t1. The external heating member is brought into contact with the fixing member when the temperature of the fixing member has become t2 by the contact with the printing paper. In this way, the surface temperature of the fixing member can be prevented from increasing instantaneously and excessively due to the contact with the external heating member. As a result, high-temperature offset can be prevented.

An image forming apparatus according to the present invention includes any of the foregoing fixing apparatuses. Thus, the temperature of the external heating member provided for the fixing member can be accurately controlled to maintain the temperature of the fixing member in a suitable range.

According to the present invention, there is provided a temperature control method for a fixing apparatus that includes: a fixing member; a pressing member; and an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, the method including: a first temperature-detecting step of detecting a surface temperature of the external heating member; a second temperature-detecting step of detecting a surface temperature of the fixing member; a first comparing step of comparing a detected temperature in the first temperature-detecting step with a controlled target temperature of the external heating member; a second comparing step of comparing a detected temperature in the second temperature-detecting step with a controlled target temperature of the fixing member; and a first control step for controlling a heating operation of the first heating device based on results of comparisons in the first comparing step and the second comparing step.

According to a temperature control method of the present invention, the heating operation of the first heating device is controlled based on results of comparisons in the first comparing step and the second comparing step. In this way, the temperature of the external heating member can be accurately controlled to maintain the temperature of the fixing member within a suitable range.

The control section of the fixing apparatus may be realized by a computer. In this case, the present invention includes a temperature control program for causing a computer to operate as the control section, and a computer-readable storage medium storing such a program.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus including: a fixing member; a pressing member; and an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, said fixing apparatus comprising:

a first temperature-detecting device for detecting a surface temperature of the external heating member;

a second temperature-detecting device for detecting a surface temperature of the fixing member; and a control section for performing first control by which a heating operation of the first heating device is controlled based on a first comparison result, which is a result of comparison between a temperature detected by the first temperature-detecting device and a controlled target temperature of the external heating member, and a second comparison result, which is a result of comparison between a temperature detected by the second temperature-detecting device and a controlled target temperature of the fixing member, wherein the first control controls the heating operation of the first heating device by increasing a temperature of the external heating member, only when the temperature detected by the first temperature-detecting device is lower than the controlled target temperature of the external heating member and when the temperature detected by the second temperature-detecting device is lower than the controlled target temperature of the fixing member, and wherein the first control controls the heating operation of the first heating device by not increasing a temperature of the external heating member, when the temperature detected by the first temperature-detecting device is equal to or greater than the controlled target temperature of the external heating member or when the temperature detected by the second temperature-detecting device is equal to or greater than the controlled target temperature of the fixing member.

2. The fixing apparatus as set forth in claim 1, wherein the first control controls the heating operation of the first heating device by not increasing a temperature of the external heating member, when the temperature detected by the first temperature-detecting device is equal to or greater than the controlled target temperature of the external heating member and when the temperature detected by the second temperature-detecting device is equal to or greater than the controlled target temperature of the fixing member.

3. The fixing apparatus as set forth in claim 1, wherein the control section controls the heating operation of the first heating device based on the first comparison result, the second comparison result, and an amount of heat that is lost per unit time from the fixing member to the printing medium.

4. The fixing apparatus as set forth in claim 3, wherein the control section controls the heating operation of the first heating device based on the first comparison result, the second comparison result, and a number of printing media subjected to a fixing process, or a time interval of feeding the printing media to a nip area between the fixing member and the pressing member.

5. The fixing apparatus as set forth in claim 1, wherein the control section controls the heating operation of the first heating device based on the first comparison result, the second comparison result, and a speed at which the printing medium passes through a nip area between the fixing member and the pressing member.

6. The fixing apparatus as set forth in claim 5, which is used for an image forming apparatus that is operative to form images in a monochromatic mode using an achromatic color material, and a color mode using a chromatic color material, the image forming apparatus adopting a different image forming speed for the monochromatic mode and the color mode, wherein the control section controls the heating operation of the first heating device based on the first comparison result, the second comparison result, and a current image formation mode selected from the monochromatic mode and the color mode.

7. The fixing apparatus as set forth in claim 1, which is operative to perform in a plurality of image formation modes with different controlled target temperatures for the fixing member, wherein the control section controls the heating operation of the first heating device based on the first comparison result, the second comparison result, and a current image formation mode.

8. The fixing apparatus as set forth in claim 7, which is used for an image forming apparatus that is operative to form images in a monochromatic mode using an achromatic color material, and a color mode using a chromatic color material, the image forming apparatus using color materials whose fixing temperature ranges are different between the monochromatic mode and the color mode, wherein the control section controls the heating operation of the first heating device based on the first comparison result, the second comparison result, and a current image formation mode selected from the monochromatic mode and the color mode.

9. The fixing apparatus as set forth in claim 1, wherein a second control controls the heating operation of the first heating device by increasing a temperature of the external heating member, when the temperature detected by the first temperature-detecting device is lower than the controlled target temperature of the external heating member, and wherein the second control controls the heating operation of the first heating device by not increasing a temperature of the external heating member, when the temperature detected by the first temperature-detecting device is equal to or greater than the controlled target temperature of the external heating member.

10. The fixing apparatus as set forth in claim 9, wherein the control section controls the heating operation of the first heating device by switching the first control, and the second control in which the heating operation of the first heating device is controlled based on the first comparison result.

11. The fixing apparatus as set forth in claim 1, wherein the fixing member is a cylindrical member whose longitudinal direction extends perpendicularly to a direction of transport of the printing medium, and wherein the second temperature-detecting device detects a surface temperature of the fixing member (i) at a middle portion in the longitudinal direction of the fixing member, (ii) at an end portion in the longitudinal direction of the fixing member, or (iii) at the middle portion and the end portion in the longitudinal direction of the fixing member.

12. The fixing apparatus as set forth in claim 1, wherein the external heating section includes a belt suspended by a plurality of support rollers, and heats the fixing member by heating the belt with the first heating device and bringing the belt into contact with the periphery of the fixing member.

13. The fixing apparatus as set forth in claim 1, which includes a release/contact section for separating the external heating member from the fixing member, wherein, when a first image formation mode and a second image formation mode are successively performed with a controlled target temperature for the fixing member lower in the second image formation mode than in the first image formation mode, the control section separates the external heating member from the fixing member after a fixing operation in the first image formation mode is finished and until the surface temperature of the fixing member as detected by the second temperature-detecting device reaches a predetermined temperature t2.

14. The fixing apparatus as set forth in claim 13, which includes a driving section for driving the fixing member to rotate, wherein the control section causes the driving section to rotate the fixing member after the fixing operation in the first image formation mode is finished and until the surface temperature of the fixing member as detected by the second temperature-detecting device reaches a predetermined temperature t1, and wherein, for a fixing operation in the second image formation mode, the control section feeds a printing medium to a nip area between the fixing member and the pressing member, after the surface temperature of the fixing member has reached the predetermined temperature t1.

15. The fixing apparatus as set forth in claim 14, wherein the predetermined temperature t1 and the predetermined temperature t2 are related to each other by $t1 \geqq t2$.

16. An image forming apparatus comprising a fixing apparatus that includes: a fixing member; a pressing member; and an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, said fixing apparatus comprising:

a first temperature-detecting device for detecting a surface temperature of the external heating member;

a second temperature-detecting device for detecting a surface temperature of the fixing member; and a control section for performing first control by which a heating operation of the first heating device is controlled based on a first comparison result, which is a result of comparison between a temperature detected by the first temperature-detecting device and a controlled target temperature of the external heating member, and a second comparison result, which is a result of comparison between a temperature detected by the second temperature-detecting device and a controlled target temperature of the fixing member, wherein the first control controls the heating operation of the first heating device by increasing a temperature of the external heating member, only when the temperature detected by the first temperature-detecting device is lower than the controlled target temperature of the external heating member and when the temperature detected by the second temperature-detecting device is lower than the controlled target temperature of the fixing member, and wherein the first control controls the heating operation of the first heating device by not increasing a temperature of the external heating member, when the temperature detected by the first temperature-detecting device is equal to or greater than the controlled target temperature of the external heating member or when the temperature detected by the second temperature-detecting device is equal to or greater than the controlled target temperature of the fixing member.

17. A temperature control method for a fixing apparatus that includes: a fixing member; a pressing member; and an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, said method comprising:

a first temperature-detecting step of detecting a surface temperature of the external heating member;

a second temperature-detecting step of detecting a surface temperature of the fixing member;

a first comparing step of comparing a detected temperature in the first temperature-detecting step with a controlled target temperature of the external heating member;

a second comparing step of comparing a detected temperature in the second temperature-detecting step with a controlled target temperature of the fixing member; and a first control step for controlling a heating operation of the first heating device based on results of comparisons in the first comparing step and the second comparing step, wherein the first control step controls the heating operation of the first heating device by increasing a temperature of the external heating member, only when the temperature detected by the first temperature-detecting device is lower than the controlled target temperature of the external heating member and when the temperature detected by the second temperature-detecting device is lower than the controlled target temperature of the fixing member, and wherein the first control step controls the heating operation of the first heating device by not increasing a temperature of the external heating member, when the temperature detected by the first temperature-detecting device is equal to or greater than the controlled target temperature of the external heating member or when the temperature detected by the second temperature-detecting device is equal to or greater than the controlled target temperature of the fixing member.

18. A computer-readable storage medium storing a temperature control program for causing a computer to operate as a control section of a fixing apparatus that includes: a fixing member; a pressing member; an external heating section that heats the fixing member by heating an external heating member with a first heating device and bringing the external heating member into contact with a periphery of the fixing member, the fixing member and the pressing member transporting a printing medium in between so that an unfixed image formed on the printing medium is fixed thereon by heating from the fixing member, a first temperature-detecting device for detecting a surface temperature of the external heating member; and a second temperature-detecting device for detecting a surface temperature of the fixing member, the temperature control program, when executed by the computer, causing the computer to perform:

a first control step by which a heating operation of the first heating device is controlled based on a first comparison result, which is a result of comparing a temperature detected by the first temperature-detecting device and a controlled target temperature of the external heating member, and a second comparison result, which is a result of comparing a temperature detected by the second temperature-detecting device and a controlled target temperature of the fixing member, wherein the first control step controls the heating operation of the first heating device by increasing a temperature of the external heating member, only when the temperature detected by the first temperature-detecting device is lower than the controlled target temperature of the external heating member and when the temperature detected by the second temperature-detecting device is lower than the controlled target temperature of the fixing member, and wherein the first control step controls the heating operation of the first heating device by not increasing a temperature of the external heating member, when the temperature detected by the first temperature-detecting device is equal to or greater than the controlled target temperature of the external heating member or when the temperature detected by the second temperature-detecting device is equal to or greater than the controlled target temperature of the fixing member.

* * * * *